US009830915B2

(12) United States Patent
Schreiner et al.

(10) Patent No.: US 9,830,915 B2
(45) Date of Patent: Nov. 28, 2017

(54) TIME DOMAIN LEVEL ADJUSTMENT FOR AUDIO SIGNAL DECODING OR ENCODING

(71) Applicant: Fraunhofer-Gesellschaft zur Foerderung der angewandten Forschung e.V., Munich (DE)

(72) Inventors: Stephan Schreiner, Birgland (DE); Arne Borsum, Erlangen (DE); Matthias Neusinger, Rohr (DE); Manuel Jander, Erlangen (DE); Markus Lohwasser, Hersbruck (DE); Bernhard Neugebauer, Erlangen (DE)

(73) Assignee: Fraunhofer-Gesellschaft zur Förderung der angewandten Forschung e.V. (DE)

( * ) Notice: Subject to any disclaimer, the term of this patent is extended or adjusted under 35 U.S.C. 154(b) by 140 days.

(21) Appl. No.: 14/795,063

(22) Filed: Jul. 9, 2015

(65) Prior Publication Data

US 2016/0019898 A1 Jan. 21, 2016

Related U.S. Application Data

(63) Continuation of application No. PCT/EP2014/050171, filed on Jan. 7, 2014.

(30) Foreign Application Priority Data

Jan. 18, 2013 (EP) ..... 13151910

(51) Int. Cl.
*G10L 19/00* (2013.01)
*G10L 21/00* (2013.01)
(Continued)

(52) U.S. Cl.
CPC ..... *G10L 19/005* (2013.01); *G10L 19/0017* (2013.01); *G10L 19/02* (2013.01);
(Continued)

(58) Field of Classification Search
CPC ..... G10L 19/00; G10L 19/0017; G10L 19/16; G10L 19/032; G10L 19/008; G10L 25/69
(Continued)

(56) References Cited

U.S. PATENT DOCUMENTS 5,796,842 A * 8/1998 Hanna ..... G10L 19/008 348/481
6,009,385 A 12/1999 Summerfield
(Continued)

FOREIGN PATENT DOCUMENTS

JP 2001-237708 8/2001
RU 2380766 C2 4/2006
(Continued)

OTHER PUBLICATIONS

Office Action dated Jun. 20, 2016 issued in co-pending Korean Patent App. No. 1020157021762 (Translated (10 pages) and Untranslated (8 pages) versions).
(Continued)

*Primary Examiner* — Paras D Shah
(74) *Attorney, Agent, or Firm* — Haynes & Boone, LLP

(57) ABSTRACT

An audio signal decoder for providing a decoded audio signal representation on the basis of an encoded audio signal representation has a decoder preprocessing stage for obtaining a plurality of frequency band signals from the encoded audio signal representation, a clipping estimator, a level shifter, a frequency-to-time-domain converter, and a level shift compensator. The clipping estimator analyzes the encoded audio signal representation and/or side information relative to a gain of the frequency band signals in order to determine a current level shift factor. The level shifter shifts levels of the frequency band signals according to the level shift factor. The frequency-to-time-domain converter converts the level shifted frequency band signals into a time-
(Continued)

domain representation. The level shift compensator acts on the time-domain representation for at least partly compensating a corresponding level shift and for obtaining a substantially compensated time-domain representation.

16 Claims, 18 Drawing Sheets

(51) Int. Cl.

| | |
|---|---|
| ***G10L 19/005*** | (2013.01) |
| ***G10L 19/02*** | (2013.01) |
| ***G10L 21/0224*** | (2013.01) |
| ***G10L 21/0232*** | (2013.01) |
| ***G10L 21/0332*** | (2013.01) |
| ***G10L 21/034*** | (2013.01) |

(52) U.S. Cl.
CPC ..... *G10L 21/0224* (2013.01); *G10L 21/0232* (2013.01); *G10L 21/034* (2013.01); *G10L 21/0332* (2013.01)

(58) Field of Classification Search
USPC ..... 704/500–504, 200
See application file for complete search history.

(56) References Cited

U.S. PATENT DOCUMENTS

| | | | | |
|---|---|---|---|---|
| 6,280,309 | B1 | 8/2001 | Van Osenbruggen | |
| 6,651,040 | B1 | 11/2003 | Bakis et al. | |
| 8,346,547 | B1 * | 1/2013 | Tang | G10L 19/035 704/201 |
| 2003/0182134 | A1 * | 9/2003 | Oyama | G10L 19/083 704/503 |
| 2005/0004793 | A1 | 1/2005 | Ojala et al. | |
| 2009/0083031 | A1 * | 3/2009 | Atlas | G10L 19/005 704/219 |
| 2009/0210238 | A1 * | 8/2009 | Kim | G10L 19/008 704/500 |
| 2009/0254783 | A1 * | 10/2009 | Hirschfeld | G10L 19/0017 714/701 |
| 2010/0266142 | A1 * | 10/2010 | Huijnen | H03G 7/002 381/102 |
| 2011/0208528 | A1 * | 8/2011 | Schildbach | G10L 19/173 704/500 |
| 2014/0133683 | A1 * | 5/2014 | Robinson | H04S 3/008 381/303 |

FOREIGN PATENT DOCUMENTS

| | | | |
|---|---|---|---|
| RU | 2325708 | C2 | 5/2008 |
| RU | 2470384 | C1 | 8/2011 |
| WO | WO 03/036616 | A1 | 10/2002 |
| WO | WO 2005/034088 | A1 | 9/2004 |
| WO | WO-2012045816 | A1 | 4/2012 |
| WO | WO 2013/087861 | A2 | 6/2013 |

OTHER PUBLICATIONS

Jing Chen et al.: MPEG-2 AAC decoder on a fixed-point DSP, Consumer Electronics, IEEE Transactions on Consumer Electronics, 1999, vol. 45 No. 4, pp. 1200-1205 (6 pages).
Yo-Cheng Hou et al.: Implementation of IMDCT for MPEG2/4 AAC on 16-bit fixed-point digital signal processors, The 2004 IEEE Asia-Pacific Conference on Circuits and Systems, 2004, pp. 813-816 (4 pages).
Randy Yates, Fixed-point arithmetic: An introduction, Digital Signal Labs, Mar. 3, 2001 (12 pages).
Marina Bosi, et al. ISO/IEC MPEG-2 advanced audio coding, Journal of the Audio engineering society, 1997, vol. 45 No. 10, pp. 789-814 (26 pages).
Japanese Office Action dated Oct. 19, 2016 issued in co-pending Japanese Patent App. No. 2015-553045 (Translated (3 pages) and Untranslated (4 pages) versions).
Bosi et al.; "ISO/IEC MPEG-2 Advanced Audio Coding"; *J. Audio. Eng. Soc.*, Oct. 1997; 45(10):789-812.
European Search Report in co-pending EPO Application No. 13151910.0 dated Jun. 18, 2013.
International Search Report in co-pending PCT Application No. PCT/EP2014/050171 dated May 23, 2014.
Quackenbush et al.; "Noiseless Coding of Quantized Spectral Components in MPEG-2 Advanced Audio Coding"; *Applications of Signal Processing to Audio and Acoustics*, IEEE ASSP Workshop, New Paltz, New York, Oct. 19-22, 1997; pp. 1-4.
Jul. 29, 2016 Russian Official Action and Search Report in co-pending PCT App. 201513457/08 (053095) (Translated and Untranslated versions).

* cited by examiner

TIME DOMAIN LEVEL ADJUSTMENT FOR AUDIO SIGNAL DECODING OR ENCODING

CROSS-REFERENCE TO RELATED APPLICATIONS

This application is a continuation of co-pending International Application No. PCT/EP2014/050171, filed Jan. 7, 2014, which is incorporated herein by reference in its entirety, and additionally claims priority from European Application No. 13151910.0, filed Jan. 18, 2013, which is also incorporated herein by reference in its entirety.

BACKGROUND OF THE INVENTION

The present invention relates to audio signal encoding, decoding, and processing, and, in particular, to adjusting a level of a signal to be frequency-to-time converted (or time-to-frequency converted) to the dynamic range of a corresponding frequency-to-time converter (or time-to-frequency converter). Some embodiments of the present invention relate to adjusting the level of the signal to be frequency-to-time converted (or time-to-frequency converted) to the dynamic range of a corresponding converter implemented in fixed-point or integer arithmetic. Further embodiments of the present invention relate to clipping prevention for spectral decoded audio signals using time domain level adjustment in combination with side information.

Audio signal processing becomes more and more important. Challenges arise as modern perceptual audio codecs are necessitated to deliver satisfactory audio quality at increasingly low bit rates.

In the current audio content production and delivery chains the digitally available master content (PCM stream (pulse code modulated stream)) is encoded e.g. by a professional AAC (Advanced Audio Coding) encoder at the content creation side. The resulting AAC bitstream is then made available for purchase e.g. through an online digital media store. It appeared in rare cases that some decoded PCM samples are "clipping" which means that two or more consecutive samples reached the maximum level that can be represented by the underlying bit resolution (e.g. 16 bit) of a uniformly quantized fixed-point representation (e.g. modulated according to PCM) for the output waveform. This may lead to audible artifacts (clicks or short distortion). Although typically an effort will be made at the encoder side to prevent the occurrence of clipping at the decoder side, clipping may nevertheless occur at the decoder side for various reasons, such as different decoder implementations, rounding errors, transmission errors, etc. Assuming an audio signal at the encoder's input that is below the threshold of clipping, the reasons for clipping in a modern perceptual audio encoder are manifold. First of all, the audio encoder applies quantization to the transmitted signal which is available in a frequency decomposition of the input waveform in order to reduce the transmission data rate. Quantization errors in the frequency domain result in small deviations of the signal amplitude and phase with respect to the original waveform. If amplitude or phase errors add up constructively, the resulting attitude in the time domain may temporarily be higher than the original waveform. Secondly, parametric coding methods (e.g. spectral band replication, SBR) parameterize the signal power in a rather course manner. Phase information is typically omitted. Consequently, the signal at the receiver side is only regenerated with correct power but without waveform preservation. Signals with an amplitude close to full scale are prone to clipping.

Modern audio coding systems offer the possibility to convey a loudness level parameter (g1) giving decoders the possibility to adjust loudness for playback with unified levels. In general, this might lead to clipping, if the audio signal is encoded at sufficiently high levels and transmitted normalization gains suggest increasing loudness levels. In addition, common practice in mastering audio content (especially music) boosts audio signals to the maximum possible values, yielding clipping of the audio signal when coarsely quantized by audio codecs.

To prevent clipping of audio signals, so called limiters are known as an appropriate tool to restrict audio levels. If an incoming audio signal exceeds a certain threshold, the limiter is activated and attenuates the audio signal in a way that the audio signal does not exceed a given level at the output. Unfortunately, prior to the limiter, sufficient headroom (in terms of dynamic range and/or bit resolution) is necessitated.

Usually, any loudness normalization is achieved in the frequency domain together with a so-called "dynamic range control" (DRC). This allows smooth blending of loudness normalization even if the normalization gain varies from frame to frame because of the filter-bank overlap.

Further, due to poor quantization or parametric description, any coded audio signal might go into clipping if the original audio was mastered at levels near the clipping threshold.

It is typically desirable to keep computational complexity, memory usage, and power consumption as small as possible in highly efficient digital signal processing devices based on a fixed-point arithmetic. For this reason, it is also desirable to keep the word length of audio samples as small as possible. To take any potential headroom for clipping due to loudness normalization into account, a filter bank, which typically is a part of an audio encoder or decoder, would have to be designed with a higher word length.

It would be desirable to allow signal limiting without losing data precision and/or without a need for using a higher word length for a decoder filter bank or an encoder filter bank. In the alternative or in addition it would be desirable if a relevant dynamic range of the signal to be frequency-to-time converted or vice versa could be determined continuously on a frame-by-frame basis for consecutive time sections or "frames" of the signal so that the level of the signal can be adjusted in a way that the current relevant dynamic range fits into the dynamic range provided by the converter (frequency-to-time domain converter or time-to-frequency-domain converter). It would also be desirable to make such a level shift for the purpose of frequency-to-time conversion or time-to-frequency conversion substantially "transparent" to other components of the decoder or encoder.

SUMMARY

According to an embodiment, an audio signal decoder configured to provide a decoded audio signal representation on the basis of an encoded audio signal representation may have: a decoder preprocessing stage configured to obtain a plurality of frequency band signals from the encoded audio signal representation; a clipping estimator configured to analyze side information relative to a gain of the frequency band signals of the encoded audio signal representation as to whether the side information suggests a potential clipping in order to determine a current level shift factor for the encoded audio signal representation, wherein when the side information suggest the potential clipping, the current level shift factor causes information of the plurality of frequency band signals to be shifted towards a least significant bit so that headroom at at least one most significant bit is gained; a level shifter configured to shift levels of the frequency band signals according to the current level shift factor for obtaining level shifted frequency band signals; a frequency-to-time-domain converter configured to convert the level shifted frequency band signals into a time-domain representation; and a level shift compensator configured to act on the time-domain representation for at least partly compensating a level shift applied to the level shifted frequency band signals by the level shifter and for obtaining a substantially compensated time-domain representation.

According to another embodiment, an audio signal encoder configured to provide an encoded audio signal representation on the basis of a time-domain representation of an input audio signal may have: a clipping estimator configured to analyze the time-domain representation of the input audio signal as to whether potential clipping is suggested in order to determine a current level shift factor for the input signal representation, wherein when the potential clipping is suggested, the current level shift factor causes the time-domain representation of the input audio signal to shifted towards a least significant bit so that headroom at at least one most significant bit is gained; a level shifter configured to shift a level of the time-domain representation of the input audio signal according to the current level shift factor for obtaining a level shifted time-domain representation; a time-to-frequency domain converter configured to convert the level shifted time-domain representation into a plurality of frequency band signals; and a level shift compensator configured to act on the plurality of frequency band signals for at least partly compensating a level shift applied to the level shifted time-domain representation by the level shifter and for obtaining a plurality of substantially compensated frequency band signals.

According to still another embodiment, a method for decoding an encoded audio signal representation and for providing a corresponding decoded audio signal representation may have the steps of: preprocessing the encoded audio signal representation to obtain a plurality of frequency band signals; analyzing side information relative to a gain of the frequency band signals as to whether the side information suggest a potential clipping in order to determine a current level shift factor for the encoded audio signal representation, wherein when the side information suggests the potential clipping, the current level shift factor causes information of the plurality of frequency band signals to be shifted towards a least significant bit so that headroom at at least one most significant bit is gained; shifting levels of the frequency band signals according to the level shift factor for obtaining level shifted frequency band signals; performing a frequency-to-time-domain conversion of the frequency band signals to a time-domain representation; and acting on the time-domain representation for at least partly compensating a level shift applied to the level shifted frequency band signals and for obtaining a substantially compensated time-domain representation.

Another embodiment may have a computer program for instructing a computer to perform the above method.

An audio signal decoder for providing a decoded audio signal representation on the basis of an encoded audio signal representation is provided. The audio signal decoder comprises a decoder preprocessing stage configured to obtain a plurality of frequency band signals from the encoded audio signal presentation. The audio signal decoder further comprises a clipping estimator configured to analyze at least one of the encoded audio signal representation, the plurality of frequency signals, and side information relative to a gain of the frequency band signals of the encoded audio signal representation as to whether the encoded audio signal information, the plurality of frequency signals, and/or the side information suggest(s) a potential clipping in order to determine a current level shift factor for the encoded audio signal representation. When the side information suggest the potential clipping, the current level shift factor causes information of the plurality of frequency band signals to be shifted towards a least significant bit so that headroom at at least one most significant bit is gained. The audio signal decoder also comprises a level shifter configured to shift levels of the frequency band signals according to the level shift factor for obtaining level shifted frequency band signals. Furthermore, the audio signal decoder comprises a frequency-to-time-domain converter configured to convert the level shifter frequency band signals into a time-domain representation. The audio signal decoder further comprises a level shift compensator configured to act on the time-domain representation for at least partly compensating a level shift applied to the level shifter frequency band signals by the level shifter and for obtaining a substantially compensated time-domain representation.

Further embodiments of the present invention provide an audio signal encoder configured to provide an encoded audio signal representation on the basis of a time-domain representation of an input audio signal. The audio signal encoder comprises a clipping estimator configured to analyze the time-domain representation of the input audio signal as to whether potential clipping is suggested in order to determine a current level shift factor for the input signal presentation. When the potential clipping is suggested, the current level shift factor causes the time-domain representation of the input audio signal to shift towards a least significant bit so that headroom at at least one most significant bit is gained. The audio signal encoder further comprises a level shifter configured to shift a level of the time-domain representation of the input audio signal according to the level shift factor for obtaining a level shifted time-domain representation. Furthermore, the audio signal encoder comprises a time-to-frequency domain converter configured to convert the level shifted time-domain representation into a plurality of frequency band signals. The audio signal encoder also comprises a level shift compensator configured to act on the plurality of frequency band signals for at least partly compensating a level shift applied to the level shifter time domain presentation by the level shifter and for obtaining a plurality of substantially compensated frequency band signals.

Further embodiments of the present invention provide a method for decoding the encoded audio signal presentation to obtain a decoded audio signal representation. The method comprises preprocessing the encoded audio signal representation to obtain a plurality of frequency band signals. The method further comprises analyzing at least one of the encoded audio signal representation, the frequency band signals, and side information relative to a gain of the frequency band signals as to whether potential clipping is suggested in order to determine a current level shift factor for the encoded audio signal presentation. When the potential clipping is suggested, the current level shift factor causes the time-domain representation of the input audio signal to shift towards a least significant bit so that headroom at at least one most significant bit is gained. Furthermore, the method comprises shifting levels of the frequency band signals according to the level shift factor for obtaining level shifted frequency band signals. The method also comprises performing a frequency-to-time-domain conversion of the frequency band signals to a time-domain representation. The method further comprises acting on the time-domain representation for at least partly compensating a level shift applied to the level shifted frequency band signals and for obtaining a substantially compensated time-domain representation.

Furthermore, a computer program for implementing the above-described methods when being executed on a computer or signal processor is provided.

Further embodiments provide an audio signal decoder for providing a decoded audio signal representation on the basis of an encoded audio signal representation is provided. The audio signal decoder comprises a decoder preprocessing stage configured to obtain a plurality of frequency band signals from the encoded audio signal presentation. The audio signal decoder further comprises a clipping estimator configured to analyze at least one of the encoded audio signal representation, the plurality of frequency signals, and side information relative to a gain of the frequency band signals of the encoded audio signal representation in order to determine a current level shift factor for the encoded audio signal representation. The audio signal decoder also comprises a level shifter configured to shift levels of the frequency band signals according to the level shift factor for obtaining level shifted frequency band signals. Furthermore, the audio signal decoder comprises a frequency-to-time-domain converter configured to convert the level shifter frequency band signals into a time-domain representation. The audio signal decoder further comprises a level shift compensator configured to act on the time-domain representation for at least partly compensating a level shift applied to the level shifter frequency band signals by the level shifter and for obtaining a substantially compensated time-domain representation.

Further embodiments of the present invention provide an audio signal encoder configured to provide an encoded audio signal representation on the basis of a time-domain representation of an input audio signal. The audio signal encoder comprises a clipping estimator configured to analyze the time-domain representation of the input audio signal in order to determine a current level shift factor for the input signal presentation. The audio signal encoder further comprises a level shifter configured to shift a level of the time-domain representation of the input audio signal according to the level shift factor for obtaining a level shifted time-domain representation. Furthermore, the audio signal encoder comprises a time-to-frequency domain converter configured to convert the level shifted time-domain representation into a plurality of frequency band signals. The audio signal encoder also comprises a level shift compensator configured to act on the plurality of frequency band signals for at least partly compensating a level shift applied to the level shifter time domain presentation by the level shifter and for obtaining a plurality of substantially compensated frequency band signals.

Further embodiments of the present invention provide a method for decoding the encoded audio signal presentation to obtain a decoded audio signal representation. The method comprises preprocessing the encoded audio signal representation to obtain a plurality of frequency band signals. The method further comprises analyzing at least one of the encoded audio signal representation, the frequency band signals, and side information relative to a gain of the frequency band signals is suggested in order to determine a current level shift factor for the encoded audio signal presentation. Furthermore, the method comprises shifting levels of the frequency band signals according to the level shift factor for obtaining level shifted frequency band signals. The method also comprises performing a frequency-to-time-domain conversion of the frequency band signals to a time-domain representation. The method further comprises acting on the time-domain representation for at least partly compensating a level shift applied to the level shifted frequency band signals and for obtaining a substantially compensated time-domain representation.

At least some of the embodiments are based on the insight that it is possible, without losing relevant information, to shift the plurality of frequency band signals of a frequency domain representation by a certain level shift factor during time intervals, in which an overall loudness level of the audio signal is relatively high. Rather, the relevant information is shifted to bits that are likely to contain noise, anyway. In this manner, a frequency-to-time-domain converter having a limited word length can be used even though a dynamic range of the frequency band signals may be larger than supported by the limited word length of the frequency-to-time-domain converter. In other words, at least some embodiments of the present invention exploit the fact that the least significant bit(s) typically does/do not carry any relevant information while the audio signal is relatively loud, i.e., while the relevant information is more likely to be contained in the most significant bit(s). The level shift applied to the level shifted frequency band signals may also have the benefit of reducing a probability of clipping to occur within the time-domain representation, where said clipping may result from a constructive superposition of one or more frequency band signals of the plurality of frequency band signals.

These insights and findings also apply in an analogous manner to the audio signal encoder and the method for encoding an original audio signal to obtain an encoded audio signal presentation.

BRIEF DESCRIPTION OF THE DRAWINGS

In the following, embodiments of the present invention are described in more detail with reference to the figures, in which.

DETAILED DESCRIPTION OF THE INVENTION

Audio processing has advanced in many ways and it has been subject of many studies, how to efficiently encode and decode an audio data signal. Efficient encoding is, for example, provided by MPEG AAC (MPEG=Moving Pictures Expert Group; AAC=Advanced Audio Coding). Some aspects of MPEG AAC are explained in more detail below, as an introduction to audio encoding and decoding. The description of MPEG AAC is to be understood as an example only, as the described concepts may be applied to other audio encoding and decoding schemes, as well.

According to MPEG AAC, spectral values of an audio signal are encoded employing scalefactors, quantization and codebooks, in particular Huffman Codebooks.

Before Huffman encoding is conducted, the encoder groups the plurality of spectral coefficients to be encoded into different sections (the spectral coefficients have been obtained from upstream components, such as a filterbank, a psychoacoustical model, and a quantizer controlled by the psychoacoustical model regarding quantization thresholds and quantization resolutions). For each section of spectral coefficients, the encoder chooses a Huffman Codebook for Huffman-encoding. MPEG AAC provides eleven different Spectrum Huffman Codebooks for encoding spectral data from which the encoder selects the codebook being best suited for encoding the spectral coefficients of the section. The encoder provides a codebook identifier identifying the codebook used for Huffman-encoding of the spectral coefficients of the section to the decoder as side information.

On a decoder side, the decoder analyses the received side information to determine which one of the plurality of Spectrum Huffman Codebooks has been used for encoding the spectral values of a section. The decoder conducts Huffman Decoding based on the side information about the Huffman Codebook employed for encoding the spectral coefficients of the section which is to be decoded by the decoder.

After Huffman Decoding, a plurality of quantized spectral values is obtained at the decoder. The decoder may then conduct inverse quantization to invert a non-uniform quantization that may have been conducted by the encoder. By this, inverse-quantized spectral values are obtained at the decoder.

However, the inverse-quantized spectral values may still be unscaled. The derived unscaled spectral values have been grouped into scalefactor bands, each scalefactor band having a common scalefactor. The scalefactor for each scalefactor band is available to the decoder as side information, which has been provided by the encoder. Using this information, the decoder multiplies the unscaled spectral values of a scalefactor band by their scalefactor. By this, scaled spectral values are obtained.

Encoding and decoding of spectral values according to the state of the art is now explained with reference to FIGS. 1-4.

Figure 1:
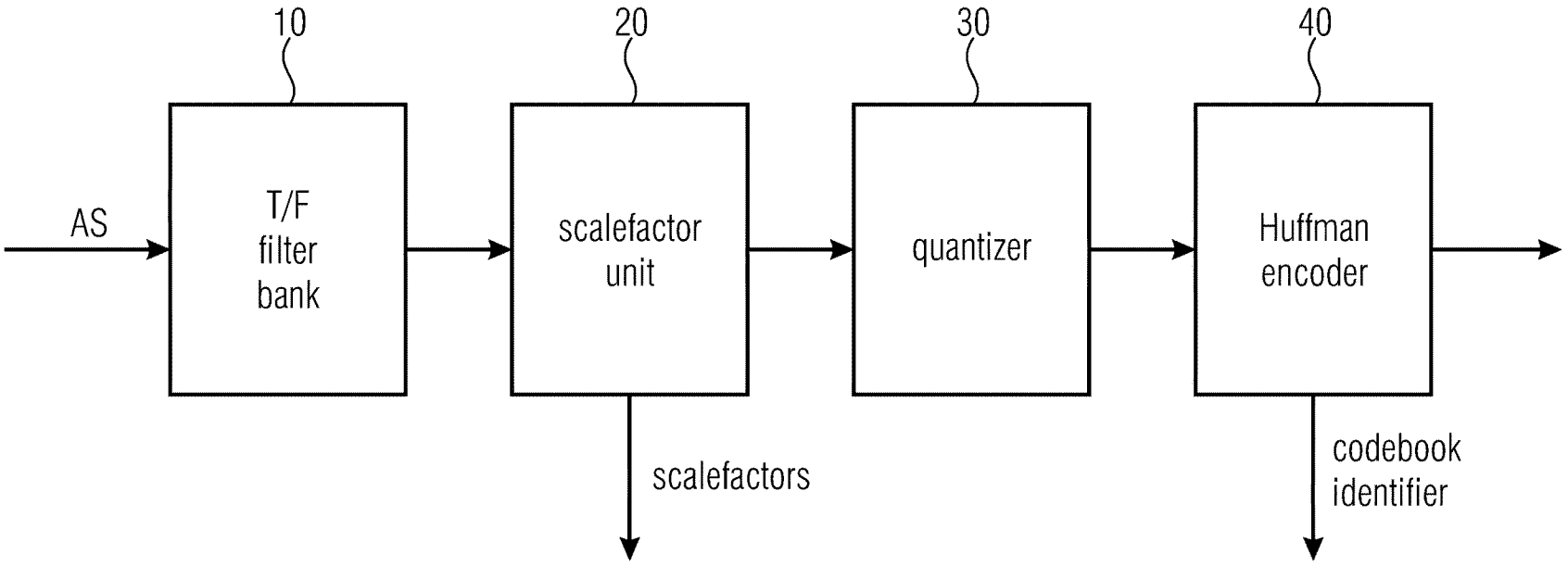
FIG 1 (PRIOR ART)
FIG. 1 illustrates an encoder according to the state of the art.

FIG. 1 illustrates an encoder according to the state of the art. The encoder comprises a T/F (time-to-frequency) filterbank 10 for transforming an audio signal AS, which shall be encoded, from a time domain into a frequency domain to obtain a frequency-domain audio signal. The frequency-domain audio signal is fed into a scalefactor unit 20 for determining scalefactors. The scalefactor unit 20 is adapted to divide the spectral coefficients of the frequency-domain audio signal in several groups of spectral coefficients called scalefactor bands, which share one scalefactor. A scalefactor represents a gain value used for changing the amplitude of all spectral coefficients in the respective scalefactor band. The scalefactor unit 20 is moreover adapted to generate and output unscaled spectral coefficients of the frequency-domain audio signal.

Moreover, the encoder in FIG. 1 comprises a quantizer for quantizing the unscaled spectral coefficients of the frequency-domain audio signal. The quantizer 30 may be a non-uniform quantizer.

After quantization, the quantized unscaled spectra of the audio signal are fed into a Huffman encoder 40 for being Huffman-encoded. Huffman coding is used for reduced redundancy of the quantized spectrum of the audio signal. The plurality of unscaled quantized spectral coefficients is grouped into sections. While in MPEG-AAC eleven possible codebooks are provided, all spectral coefficients of a section are encoded by the same Huffman codebook.

The encoder will choose one of the eleven possible Huffman codebooks that is particularly suited for encoding the spectral coefficients of the section. By this, the selection of the Huffman codebook of the encoder for a particular section depends on the spectral values of the particular section. The Huffman-encoded spectral coefficients may then be transmitted to the decoder along with side information comprising e.g., information about the Huffman codebook that has been used for encoding a section of spectral coefficients, a scalefactor that has been used for a particular scalefactor band etc.

Two or four spectral coefficients are encoded by a codeword of the Huffman codebook employed for Huffman-encoding the spectral coefficients of the section. The encoder transmits the codewords representing the encoded spectral coefficients to the decoder along with side information comprising the length of a section as well as information about the Huffman codebook used for encoding the spectral coefficients of the section.

In MPEG AAC, eleven Spectrum Huffman codebooks are provided for encoding spectral data of the audio signal. The different Spectrum Huffman codebook may be identified by their codebook index (a value between 1 and 11). The dimension of the Huffman codebook indicates how many spectral coefficients are encoded by a codeword of the considered Huffman codebook. In MPEG AAC, the dimension of a Huffman codebook is either 2 or 4 indicating that a codeword either encodes two or four spectral values of the audio signal.

However the different Huffman codebooks also differ regarding other properties. For example, the maximum absolute value of a spectral coefficient that can be encoded by the Huffman codebook varies from codebook to codebook and can, for example, be 1, 2, 4, 7, 12 or greater.

Moreover, a considered Huffman codebook may be adapted to encode signed values or not.

Employing Huffman-encoding, the spectral coefficients are encoded by codewords of different lengths. MPEG AAC provides two different Huffman codebooks having a maximum absolute value of 1, two different Huffman codebooks having a maximum absolute value of 2, two different Huffman codebooks having a maximum absolute value of 4, two different Huffman codebooks having an maximum absolute value of 7 and two different Huffman codebooks having an maximum absolute value of 12, wherein each Huffman codebook represents a distinct probability distribution function. The Huffman encoder will always choose the Huffman codebook that fits best for encoding the spectral coefficients.

Figure 2:
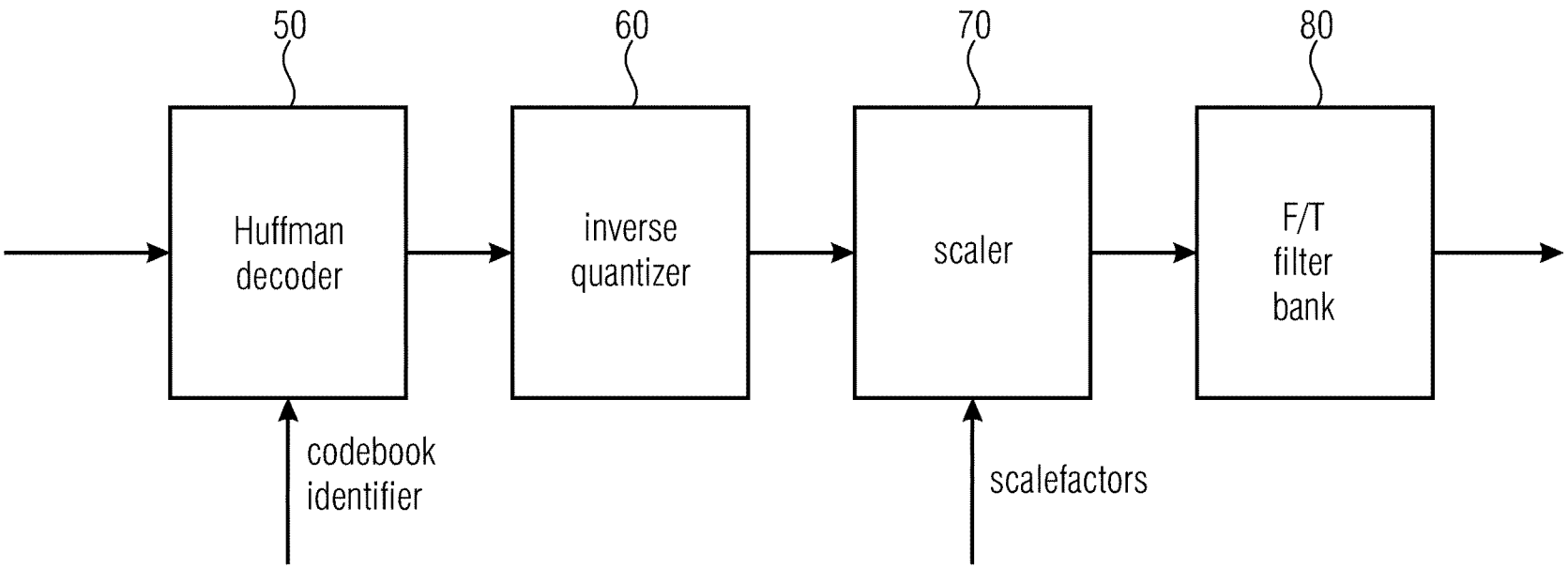
FIG 2 (PRIOR ART)
FIG. 2 depicts a decoder according to the state of the art.

FIG. 2 illustrates a decoder according to the state of the art. Huffman-encoded spectral values are received by a Huffman decoder 50. The Huffman decoder 50 also receives, as side information, information about the Huffman codebook used for encoding the spectral values for each section of spectral values. The Huffman decoder 50 then performs Huffman decoding for obtaining unscaled quantized spectral values. The unscaled quantized spectral values are fed into an inverse quantizer 60. The inverse quantizer performs inverse quantization to obtain inverse-quantized unscaled spectral values, which are fed into a scaler 70. The scaler 70 also receives scalefactors as side information for each scalefactor band. Based on the received scalefactors, the scaler 70 scales the unscaled inverse-quantized spectral values to obtain scaled inverse-quantized spectral values. An F/T filter bank 80 then transforms the scaled inverse-quantized spectral values of the frequency-domain audio signal from the frequency domain to the time domain to obtain sample values of a time-domain audio signal.

Figure 3:
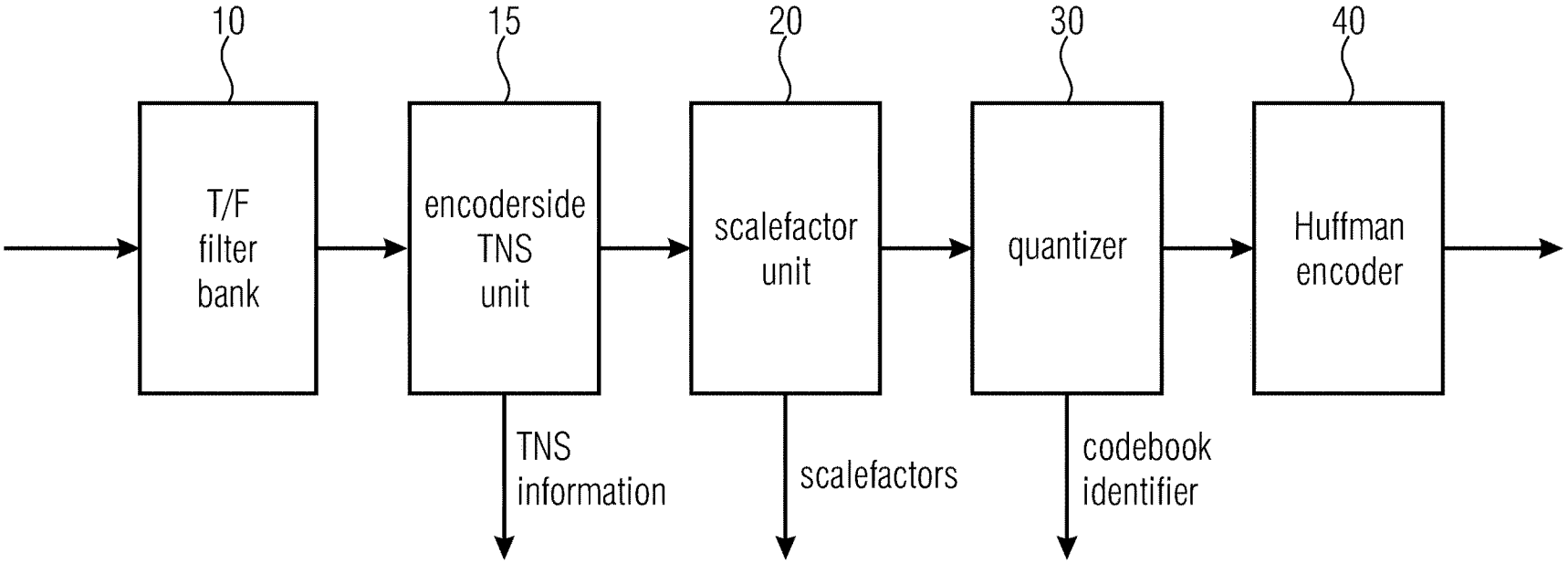
FIG 3 (PRIOR ART)
FIG. 3 illustrates another encoder according to the state of the art.

FIG. 3 illustrates an encoder according to the state of the art differing from the encoder of FIG. 1 in that the encoder of FIG. 3 further comprises an encoder-side TNS unit (TNS=Temporal Noise Shaping). Temporal Noise Shaping may be employed to control the temporal shape of quantization noise by conducting a filtering process with respect to portions of the spectral data of the audio signal. The encoder-side TNS unit 15 conducts a linear predictive coding (LPC) calculation with respect to the spectral coefficients of the frequency-domain audio signal to be encoded. Inter alia resulting from the LPC calculation are reflection coefficients, also referred to as PARCOR coefficients. Temporal noise shaping is not used if the prediction gain, that is also derived by the LPC calculation, does not exceed a certain threshold value. However, if the prediction gain is greater than the threshold value, temporal noise shaping is employed. The encoder-side TNS unit removes all reflection coefficients that are smaller than a certain threshold value. The remaining reflection coefficients are converted into linear prediction coefficients and are used as noise shaping filter coefficients in the encoder. The encoder-side TNS unit then performs a filter operation on those spectral coefficients, for which TNS is employed, to obtain processed spectral coefficients of the audio signal. Side information indicating TNS information, e.g. the reflection coefficients (PARCOR coefficients) is transmitted to the decoder.

Figure 4:
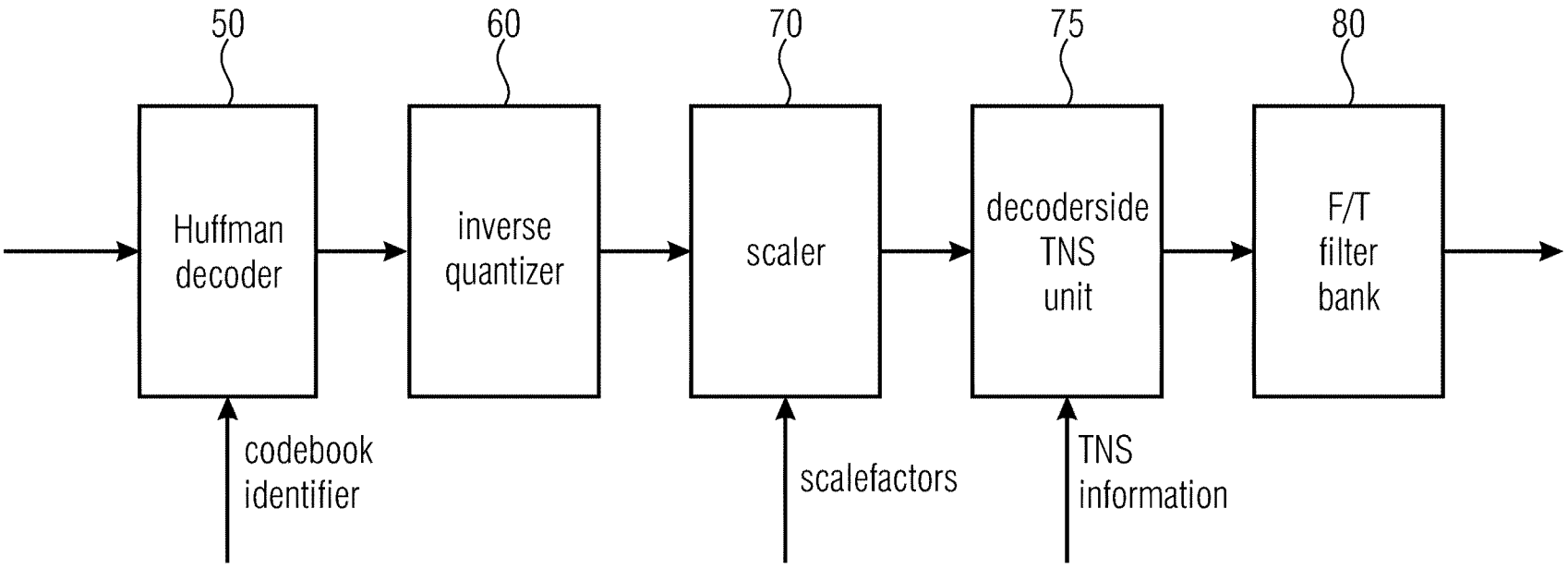
FIG 4 (PRIOR ART)
FIG. 4 depicts a further decoder according to the state of the art.

FIG. 4 illustrates a decoder according to the state of the art which differs from the decoder illustrated in FIG. 2 insofar as the decoder of FIG. 4 furthermore comprises a decoder-side TNS unit 75. The decoder-side TNS unit receives inverse-quantized scaled spectra of the audio signal and also receives TNS information, e.g., information indicating the reflection coefficients (PARCOR coefficients). The decoder-side TNS unit 75 processes the inversely-quantized spectra of the audio signal to obtain a processed inversely quantized spectrum of the audio signal.

Figure 5:
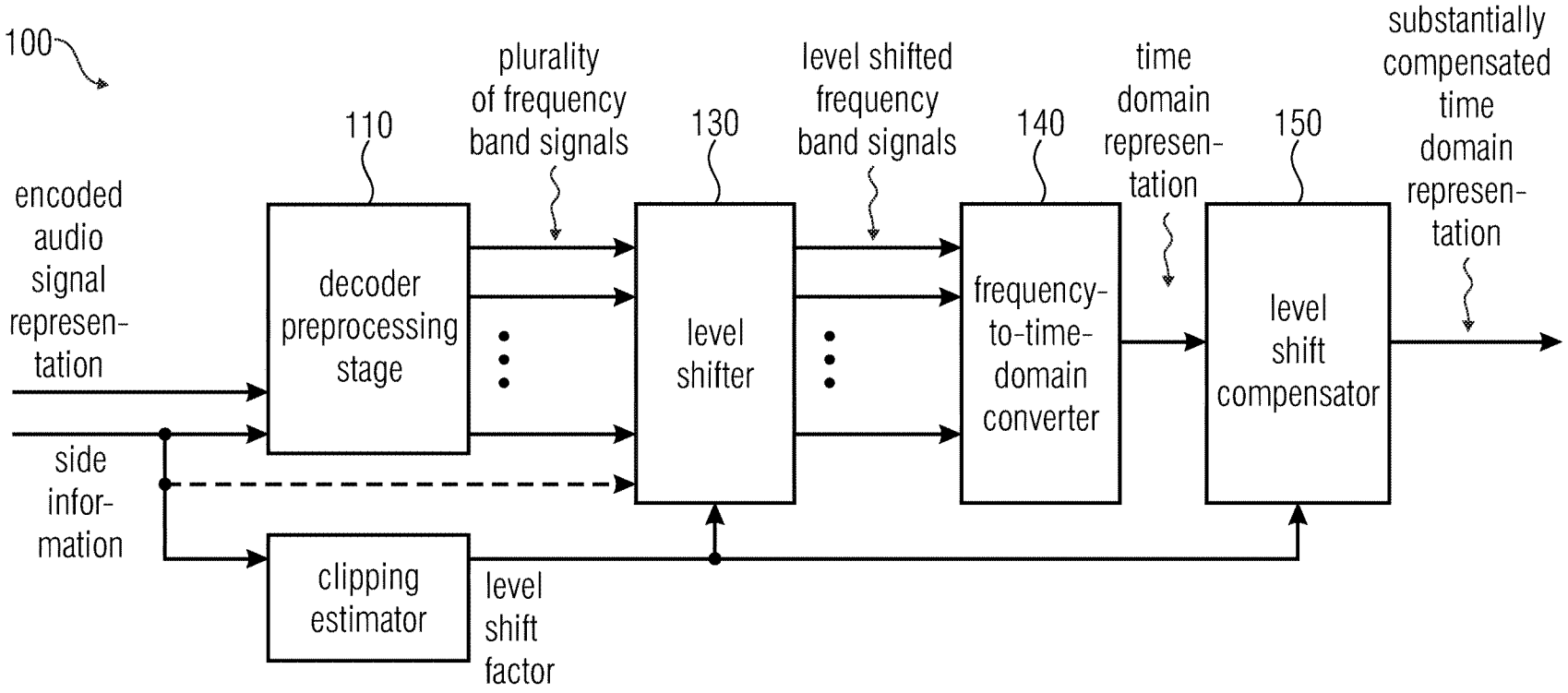
FIG. 5 shows a schematic block diagram of an audio signal decoder according to at least one embodiment.

FIG. 5 shows a schematic block diagram of an audio signal decoder 100 according to at least one embodiment of the present invention. The audio signal decoder is configured to receive an encoded audio signal representation. Typically, the encoded audio signal presentation is accompanied by side information. The encoded audio signal representation along with the side information may be provided in the form of a datastream that has been produced by, for example, a perceptual audio encoder. The audio signal decoder 100 is further configured to provide a decoded audio signal representation that may be identical to the signal labeled "substantially compensated time-domain representation" in FIG. 5 or derived therefrom using subsequent processing.

The audio signal decoder 100 comprises a decoder preprocessing stage 110 that is configured to obtain a plurality of frequency band signals from the encoded audio signal representation. For example, the decoder preprocessing stage 110 may comprise a bitstream unpacker in case the encoded audio signal representation and the side information are contained in a bitstream. Some audio encoding standards may use time-varying resolutions and also different resolutions for the plurality of frequency band signals, depending on the frequency range in which the encoded audio signal presentation currently carries relevant information (high resolution) or irrelevant information (low resolution or no data at all). This means that a frequency band in which the encoded audio signal representation currently has a large amount of relevant information is typically encoded using a relatively fine resolution (i.e., using a relatively high number of bits) during that time interval, in contrast to a frequency band signal that temporarily carries no or only very few information. It may even happen that for some of the frequency band signals the bitstream temporarily contains no data or bits, at all, because these frequency band signals do not contain any relevant information during the corresponding time interval. The bitstream provided to the decoder preprocessing stage 110 typically contains information (e.g., as part of the side information) indicating which frequency band signals of the plurality of frequency band signals contain data for the currently considered time interval or "frame", and the corresponding bit resolution.

The audio signal decoder 100 further comprises a clipping estimator 120 configured to analyze the side information relative to a gain of the frequency band signals of the encoded audio signal representation in order to determine a current level shift factor for the encoded audio signal representation. Some perceptual audio encoding standards use individual scale factors for the different frequency band signals of the plurality of frequency band signals. The individual scale factors indicate for each frequency band signal the current amplitude range, relative to the other frequency band signals. For some embodiments of the present invention an analysis of these scale factors allows an approximate assessment of a maximal amplitude that may occur in a corresponding time-domain representation after the plurality of frequency band signals have been converted from a frequency domain to a time domain. This information may then be used in order to determine if, without any appropriate processing as proposed by the present invention, clipping would be likely to occur within the time-domain representation for the considered time interval or "frame". The clipping estimator 120 is configured to determine a level shift factor that shifts all the frequency band signals of the plurality of frequency band signals by an identical amount with respect to the level (regarding a signal amplitude or a signal power, for example). The level shift factor may be determined for each time interval (frame) in an individual manner, i.e., the level shift factor is time-varying. Typically, the clipping estimator 120 will attempt to adjust the levels of the plurality of frequency band signals by the shift factor that is common to all the frequency band signals in a way that clipping within the time-domain representation is very unlikely to occur, but at the same time maintaining a reasonable dynamic range for the frequency band signals. As an example, consider a frame of the encoded audio signal representation in which a number of the scale factors are relatively high. The clipping estimator 120 may now consider the worst-case, that is, possible signal peaks within the plurality of frequency band signals overlap or add up in a constructive manner, resulting in a large amplitude within the time-domain representation. The level shift factor may now be determined as a number that causes this hypothetical peak within the time-domain representation to be within a desired dynamic range, possibly with the additional consideration of a margin. At least according to some embodiments the clipping estimator 120 does not need the encoded audio signal representation itself for assessing a probability of clipping within the time-domain representation for the considered time interval or frame. The reason is that at least some perceptual audio encoding standards choose the scale factors for the frequency band signals of the plurality of frequency band signals according to the largest amplitude that has to be coded within a certain frequency band signal and the considered time interval. In other words, the highest value that can be represented by the chosen bit resolution for the frequency band signal at hand is very likely to occur at least once during the considered time interval or frame, given the properties of the encoding scheme. Using this assumption, the clipping estimator 120 may focus on evaluating the side information relative to the gain(s) of the frequency band signals (e.g., said scale factor and possibly further parameters) in order to determine the current level shift factor for the encoded audio signal representation and the considered time interval (frame).

The audio signal decoder 100 further comprises a level shifter 130 configured to shift levels of the frequency band signals according to the level shift factor for obtaining level shifted frequency band signals.

The audio signal decoder 100 further comprises a frequency-to-time-domain converter 140 configured to convert the level shifted frequency band signals into a time-domain representation. The frequency-to-time-domain converter 140 may be an inverse filter bank, an inverse modified discrete cosine transformation (inverse MDCT), an inverse quadrature mirror filter (inverse QMF), to name a few. For some audio coding standards the frequency-to-time-domain converter 140 may be configured to support windowing of consecutive frames, wherein two frames overlap for, e.g., 50% of their duration.

The time-domain representation provided by the frequency-to-time-domain converter 140 is provided to a level shift compensator 150 that is configured to act on the time-domain representation for at least partly compensating a level shift applied to the level shifted frequency band signals by the level shifter 130, and for obtaining a substantially compensated time-domain representation. The level shift compensator 150 further receives the level shift factor from the clipping estimator 140 or a signal derived from the level shift factor. The level shifter 130 and the level shift compensator 150 provide a gain adjustment of the level shifted frequency band signals and a compensating gain adjustment of the time domain presentation, respectively, wherein said gain adjustment bypasses the frequency-to-time-domain converter 140. In this manner, the level shifted frequency band signals and the time-domain representation can be adjusted to a dynamic range provided by the frequency-to-time-domain converter 140 which may be limited due to a fixed word length and/or a fixed-point arithmetic implementation of the converter 140. In particular, the relevant dynamic range of the level shifted frequency band signals and the corresponding time-domain representation may be at relatively high amplitude values or signal power levels during relatively loud frames. In contrast, the relevant dynamic range of the level shifted frequency band signal and consequently also of the corresponding time-domain representation may be at relatively small amplitude values or signal power values during relatively soft frames. In the case of loud frames, the information contained in the lower bits of a binary presentation of the level shifted frequency band signals may typically be regarded as negligible compared to the information that is contained within the higher bits. Typically, the level shift factor is common to all frequency band signals which makes it possible to compensate the level shift applied to the level shifted frequency band signals even downstream of the frequency-to-time-domain converter 140. In contrast to the proposed level shift factor which is determined by the audio signal decoder 100 itself, the so-called global gain parameter is contained within the bitstream that was produced by a remote audio signal encoder and provided to the audio signal decoder 100 as an input. Furthermore, the global gain is applied to the plurality of frequency band signals between the decoder preprocessing stage 110 and the frequency-to-time-domain converter 140. Typically, the global gain is applied to the plurality of frequency band signals at substantially the same place within the signal processing chain as the scale factors for the different frequency band signals. This means that for a relatively loud frame the frequency band signals provided to the frequency-to-time-domain converter 140 are already relatively loud, and may therefore cause clipping in the corresponding time-domain representation, because the plurality of frequency band signals did not provide sufficient headroom in case the different frequency band signals add up in a constructive manner, thereby leading to a relatively high signal amplitude within the time-domain representation.

The proposed approach that is for example implemented by the audio signal decoder 100 schematically illustrated in FIG. 5 allows signal limiting without losing data precision or using higher word length for decoder filter-banks (e.g, the frequency-to-time-domain converter 140).

To overcome the problem of restricted word length of filter-banks, the loudness normalization as source of potential clipping may be moved to the time domain processing. This allows the filter-bank 140 to be implemented with original word length or reduced word length compared to an implementation where the loudness normalization is performed within the frequency domain processing. To perform a smooth blending of gain values, a transition shape adjustment may be performed as will be explained below in the context of FIG. 9.

Further, audio samples within the bitstream are usually quantized at lower precision than the reconstructed audio signal. This allows for some headroom in the filter-bank 140. The decoder 100 derives some estimate from other bitstream parameter p (such as the global gain factor) and, for the case clipping of the output signal is likely, applies a level shift (g2) to avoid the clipping in the filter-bank 140. This level shift is signaled to the time domain for proper compensation by the level shift compensator 150. If no clipping is estimated, the audio signal remains unchanged and therefore the method has no loss in precision.

The clipping estimator may be further configured to determine a clipping probability on the basis of the side information and/or to determine the current level shift factor on the basis of the clipping probability. Even though the clipping probability only indicates a trend, rather than a hard fact, it may provide useful information regarding the level shift factor that may be reasonably applied to the plurality of frequency band signals for a given frame of the encoded audio signal representation. The determination of the clipping probability may be relatively simple in terms of computational complexity or effort and compared to the frequency-to-time-domain conversion performed by the frequency-to-time-domain converter 140.

The side information may comprise at least one of a global gain factor for the plurality of frequency band signals and a plurality of scale factors. Each scale factor may correspond to one or more frequency band signals of the plurality of frequency band signals. The global gain factor and/or the plurality of scale factors already provide useful information regarding a loudness level of the current frame that is to be converted to the time domain by the converter 140.

According to at least some embodiments the decoder preprocessing stage 110 may be configured to obtain the plurality of frequency band signals in the form of a plurality of successive frames. The clipping estimator 120 may be configured to determine the current level shift factor for a current frame. In other words, the audio signal decoder 100 may be configured to dynamically determine varying level shift factors for different frames of the encoded audio signal representation, for example depending on a varying degree of loudness within the successive frames.

The decoded audio signal representation may be determined on the basis of the substantially compensated time-domain representation. For example, the audio signal decoder 100 may further comprise a time domain limiter downstream of the level shift compensator 150. According to some embodiments, the level shift compensator 150 may be a part of such a time domain limiter.

According to further embodiments, the side information relative to the gain of the frequency band signals may comprise a plurality of frequency band-related gain factors.

The decoder preprocessing stage 110 may comprise an inverse quantizer configured to re-quantize each frequency band signal using a frequency band-specific quantization indicator of a plurality of frequency band-specific quantization indicators. In particular, the different frequency band signals may have been quantized using different quantization resolutions (or bit resolutions) by an audio signal encoder that has created the encoded audio signal presentation and the corresponding side information. The different frequency band-specific quantization indicators may therefore provide an information about an amplitude resolution for the various frequency band signals, depending on a necessitated amplitude resolution for that particular frequency band signal determined earlier by the audio signal encoder. The plurality of frequency band-specific quantization indicators may be part of the side information provided to the decoder preprocessing stage 110 and may provide further information to be used by at the clipping estimator 120 for determining the level shift factor.

The clipping estimator 120 may be further configured to analyze the side information with respect to whether the side information suggests a potential clipping within the time-domain representation. Such a finding would then be interpreted as a least significant bit (LSB) containing no relevant information. In this case the level shift applied by the level shifter 130 may shift information towards the least significant bit so that by freeing a most significant bit (LSB) some headroom at the most significant bit is gained, which may be needed for the time domain resolution in case two or more of the frequency band signals add up in a constructive manner. This concept may also be extended to the n least significant bits and the n most significant bits.

The clipping estimator 120 may be configured to consider a quantization noise. For example, in AAC decoding, both the "global gain" and the "scale factor bands" are used to normalize the audio/subband. As a consequence, the relevant information by each (spectral) value is shifted to the MSB, while the LSB are neglected in quantization. After re-quantization in the decoder, the LSB typically contained(s) noise, only. If the "global gain" and the "scale factor band" (p) values suggest a potential clipping after the reconstruction filter-bank 140, it can be reasonably assumed that the LSB contained no information. With the proposed method, the decoder 100 shifts the information also into these bits to gain some headroom with the MSB. This causes substantially no loss of information.

The proposed apparatus (audio signal decoder or encoder) and methods allow clipping prevention for audio decoders/encoders without spending a high resolution filter-bank for the necessitated headroom. This is typically much less expensive in terms of memory requirements and computational complexity than performing/implementing a filter-bank with higher resolution.

Figure 6:
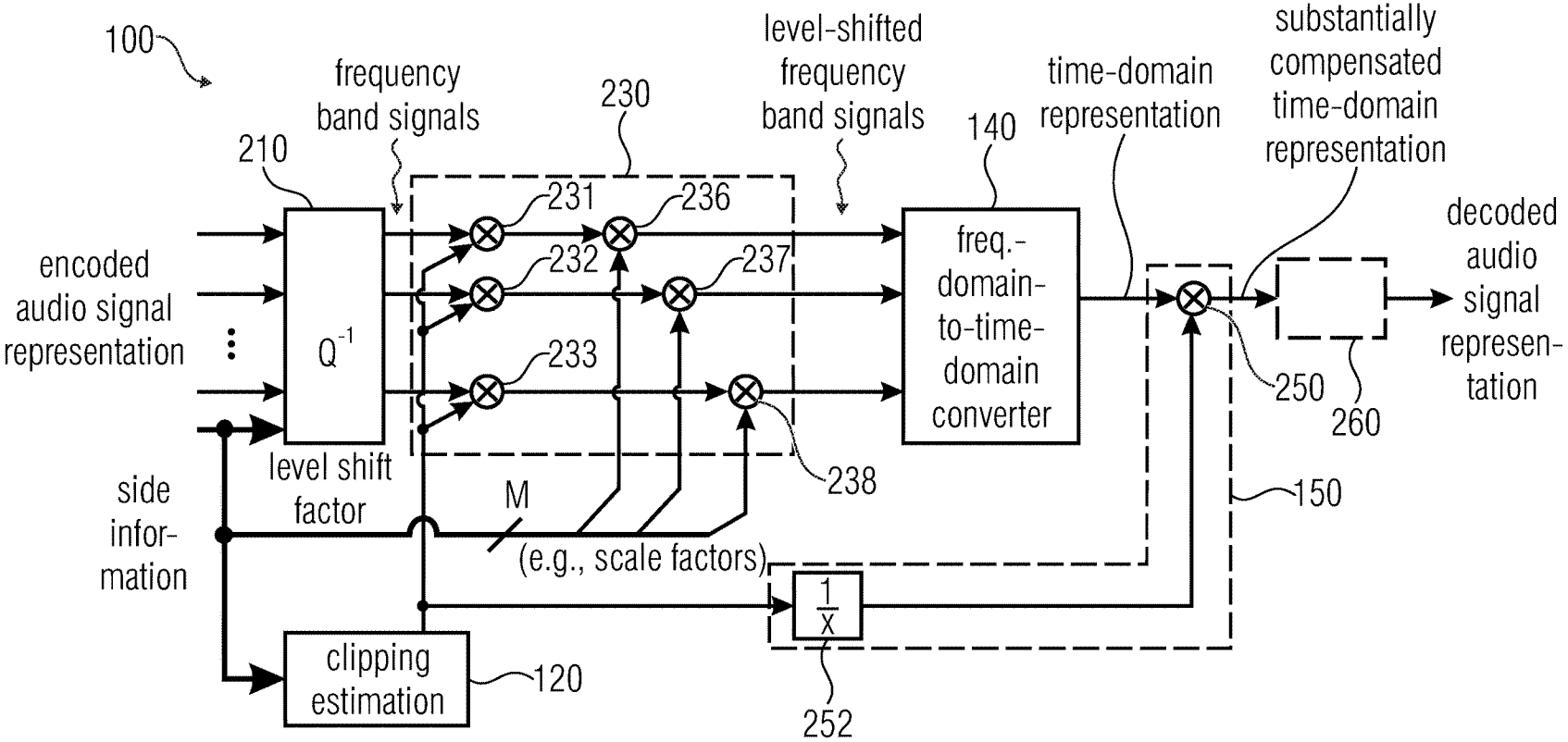
FIG. 6 shows a schematic block diagram of an audio signal decoder according to at least one further embodiment.

FIG. 6 shows a schematic block diagram of an audio signal decoder 100 according to further embodiments of the present invention. The audio signal decoder 100 comprises an inverse quantizer 210 (Q−1) that is configured to receive the encoded audio signal representation and typically also the side information or a part of the side information. In some embodiments, the inverse quantizer 210 may comprise a bitstream unpacker configured to unpack a bitstream which contains the encoded audio signal representation and the side information, for example in the form of data packets, wherein each data packet may correspond to a certain number of frames of the encoded audio signal representation. As explained above, within the encoded audio signal representation and within each frame, each frequency band may have its own individual quantization resolution. In this manner, frequency bands that temporarily necessitate a relatively fine quantization, in order to correctly represent the audio signal portions within said frequency bands, may have such a fine quantization resolution. On the other hand, frequency bands that contain, during a given frame, no or only a small amount of information may be quantized using a much coarser quantization, thereby saving data bits. The inverse quantizer 210 may be configured to bring the various frequency bands, that have been quantized using individual and time-varying quantization resolutions, to a common quantization resolution. The common quantization resolution may be, for example, the resolution provided by a fixed-point arithmetic representation that is used by the audio signal decoder 100 internally for calculations and processing. For example, the audio signal decoder 100 may use a 16-bit or 24-bit fixed-point representation internally. The side information provided to the inverse quantizer 210 may contain information regarding the different quantization resolutions for the plurality of frequency band signals for each new frame. The inverse quantizer 210 may be regarded as a special case of the decoder preprocessing stage 110 depicted in FIG. 5.

The clipping estimator 120 shown in FIG. 6 is similar to the clipping estimator 120 in FIG. 5.

The audio signal decoder 100 further comprises the level shifter 230 that is connected to an output of the inverse quantizer 210. The level shifter 230 further receives the side information or a part of the side information, as well as the level shift factor that is determined by the clipping estimator 120 in a dynamic manner, i.e., for each time interval or frame, the level shift factor may assume a different value. The level shift factor is consistently applied to the plurality of frequency band signals using a plurality of multipliers or scaling elements 231, 232, and 233. It may occur that some of the frequency band signals are relatively strong when leaving the inverse quantizer 210, possibly using their respective MSBs already. When these strong frequency band signals add up within the frequency-to-time-domain converter 140, an overflow may be observed within the time-domain representation output by the frequency-to-time-domain converter 140. The level shift factor determined by the clipping estimator 120 and applied by the scaling elements 231, 232, 233 makes it possible to selectively (i.e., taking into account the current side information) reduce the levels of the frequency band signals so that an overflow of the time-domain representation is less likely to occur. The level shifter 230 further comprises a second plurality of multipliers or scaling elements 236, 237, 238 configured to apply the frequency band-specific scale factors to the corresponding frequency bands. The side information may comprise M scale factors. The level shifter 230 provides the plurality of level shifted frequency band signals to the frequency-to-time-domain converter 140 which is configured to convert the level shifted frequency band signals into the time-domain representation.

The audio signal decoder 100 of FIG. 6 further comprises the level shift compensator 150 which comprises in the depicted embodiment a further multiplier or scaling element 250 and a reciprocal calculator 252. The reciprocal calculator 252 receives the level shift factor and determines the reciprocal (1/x) of the level shift factor. The reciprocal of the level shift factor is forwarded to the further scaling element 250 where it is multiplied with the time-domain representation to produce the substantially compensated time-domain representation. As an alternative to the multipliers or scaling elements 231, 232, 233, and 252 it may also be possible to use additive/subtractive elements for applying the level shift factor to the plurality of frequency band signals and to the time-domain representation.

Optionally, the audio signal decoder 100 in FIG. 6 further comprises a subsequent processing element 260 connected to an output of the level shift compensator 150. For example, the subsequent processing element 260 may comprise a time domain limiter having a fixed characteristic in order to reduce or remove any clipping that may still be present within the substantially compensated time-domain representation, despite the provision of the level shifter 230 and the level shift compensator 150. An output of the optional subsequent processing element 260 provides the decoded audio signal representation. In case the optional subsequent processing element 260 is not present, the decoded audio signal representation may be available at the output of the level shift compensator 150.

Figure 7:
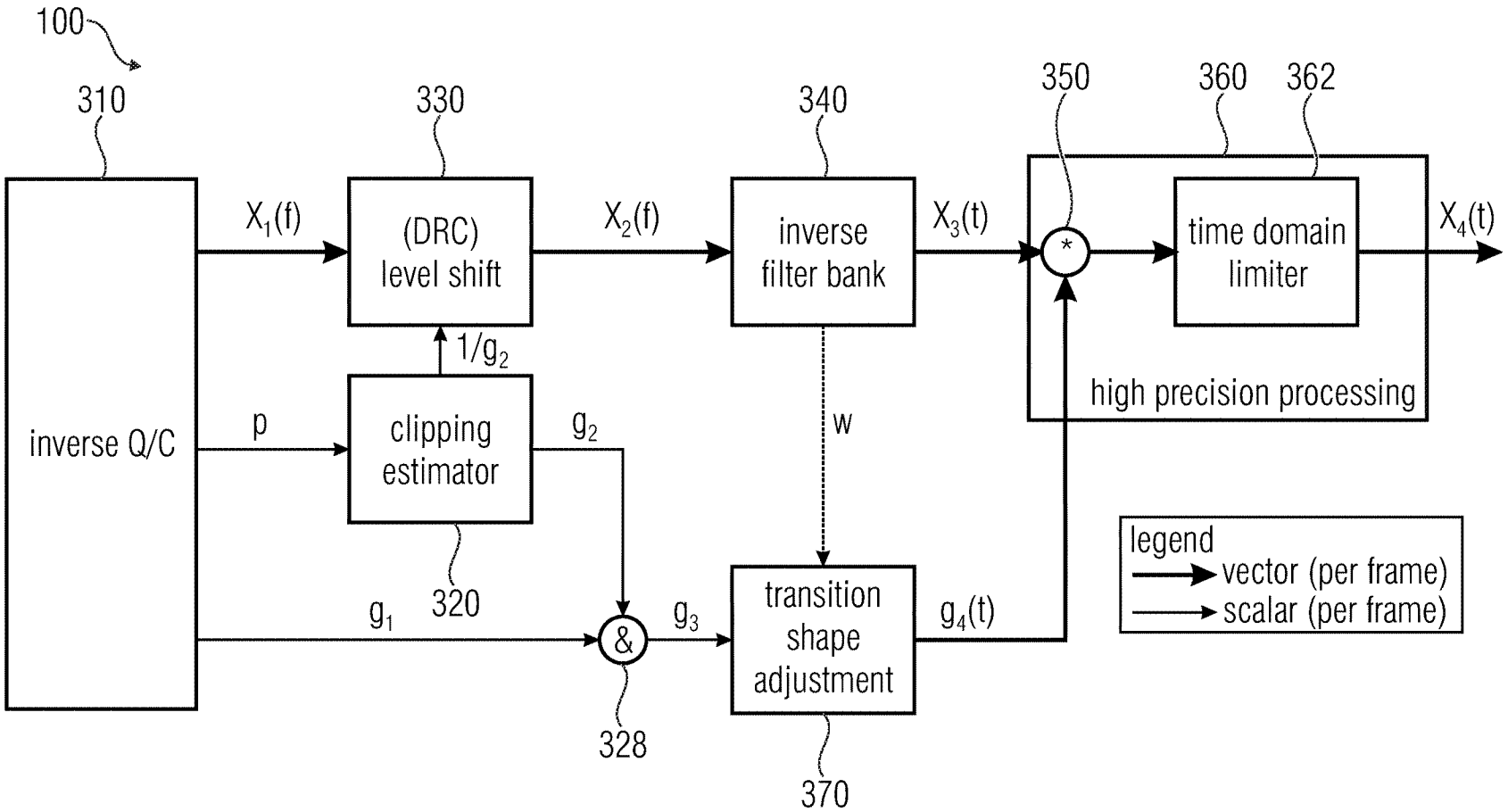
FIG. 7 shows a schematic block diagram illustrating a concept of the proposed audio signal decoder and the proposed method for decoding an encoded audio signal representation according to embodiments.

FIG. 7 shows a schematic block diagram of an audio signal decoder 100 according to further possible embodiments of the present invention. An inverse quantizer/bitstream decoder 310 is configured to process an incoming bitstream and to derive the following information therefrom: the plurality of frequency band signals X1(f), bitstream parameters p, and a global gain g1. The bitstream parameters p may comprise the scale factors for the frequency bands and/or the global gain g1.

The bitstream parameters p are provided to the clipping estimator 320 which derives the scaling factor 1/g2 from the bitstream parameters p. The scaling factor 1/g2 is fed to the level shifter 330 which in the depicted embodiment also implements a dynamic range control (DRC). The level shifter 330 may further receive the bitstream parameters p or a portion thereof in order to apply the scale factors to the plurality of frequency band signals. The level shifter 330 outputs the plurality of level shifted frequency band signals X2(f) to the inverse filter bank 340 which provides the frequency-to-time-domain conversion. At an output of the inverse filter bank 340, the time-domain representation X3(t) is provided to be supplied to the level shift compensator 350. The level shift compensator 350 is a multiplier or scaling element, as in the embodiment depicted in FIG. 6. The level shift compensator 350 is a part of a subsequent time domain processing 360 for high precision processing, e.g., supporting a longer word length than the inverse filter bank 340. For example, the inverse filter bank may have a word length of 16 bits and the high precision processing performed by the subsequent time domain processing may be performed using 20 bits. As another example, the word length of the inverse filter bank 340 may be 24 bits and the word length of the high precision processing may be 30 bits. In any event, the number of bits shall not be considered as limiting the scope of the present patent/patent application unless explicitly stated. The subsequent time domain processing 360 outputs the decoded audio signal representation X4(t).

The applied gain shift g2 is fed forward to the limiter implementation 360 for compensation. The limiter 362 may be implemented at high precision.

If the clipping estimator 320 does not estimate any clipping, the audio samples remain substantially unchanged, i.e. as if no level shift and level shift compensation would have been performed.

The clipping estimator provides the reciprocal g2 of the level shift factor 1/g2 to a combiner 328 where it is combined with the global gain g1 to yield a combined gain g3.

The audio signal decoder 100 further comprises a transition shape adjustment 370 that is configured to provide smooth transitions when the combined gain g3 changes abruptly from a preceding frame to a current frame (or from the current frame to a subsequent frame). The transition shape adjuster 370 may be configured to crossfade the current level shift factor and a subsequent level shift factor to obtain a crossfaded level shift factor g4 for use by the level shift compensator 350. To allow for smooth transition of changing gain factors, a transition shape adjustment has to be performed. This tool creates a vector of gain factors g4(t) (one factor for each sample of the corresponding audio signal). To mimic the same behavior of the gain adjustment that the processing of the frequency domain signal would yield, the same transition windows W from the filter-bank 340 have to be used. One frame covers a plurality of samples. The combined gain factor g3 is typically constant for the duration of one frame. The transition window W is typically one frame long and provides different window values for each sample within the frame (e.g., the first half-period of a cosine). Details regarding one possible implementation of the transition shape adjustment are provided in FIG. 9 and the corresponding description below.

Figure 8:
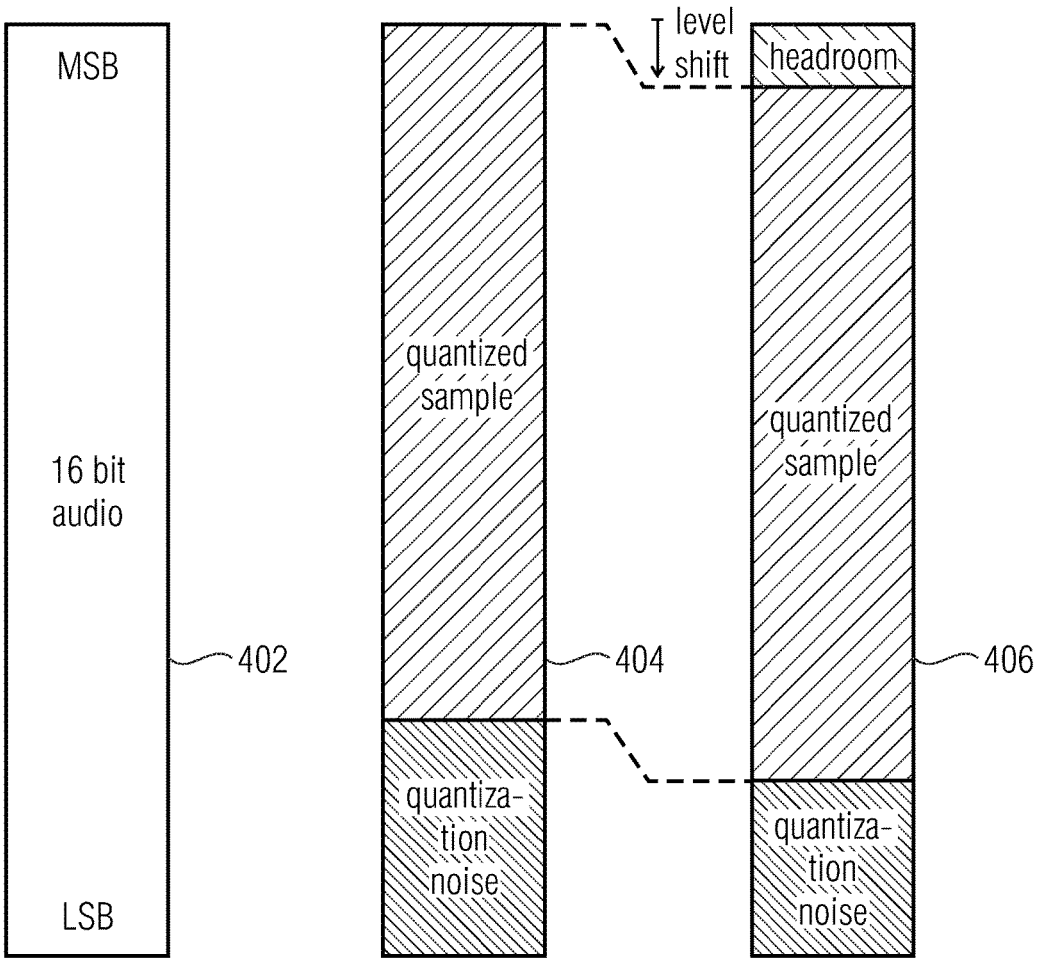
FIGS. 8A-8C represent a schematic visualization of level shift to gain headroom.
Figures 8A, 8B, 8C:
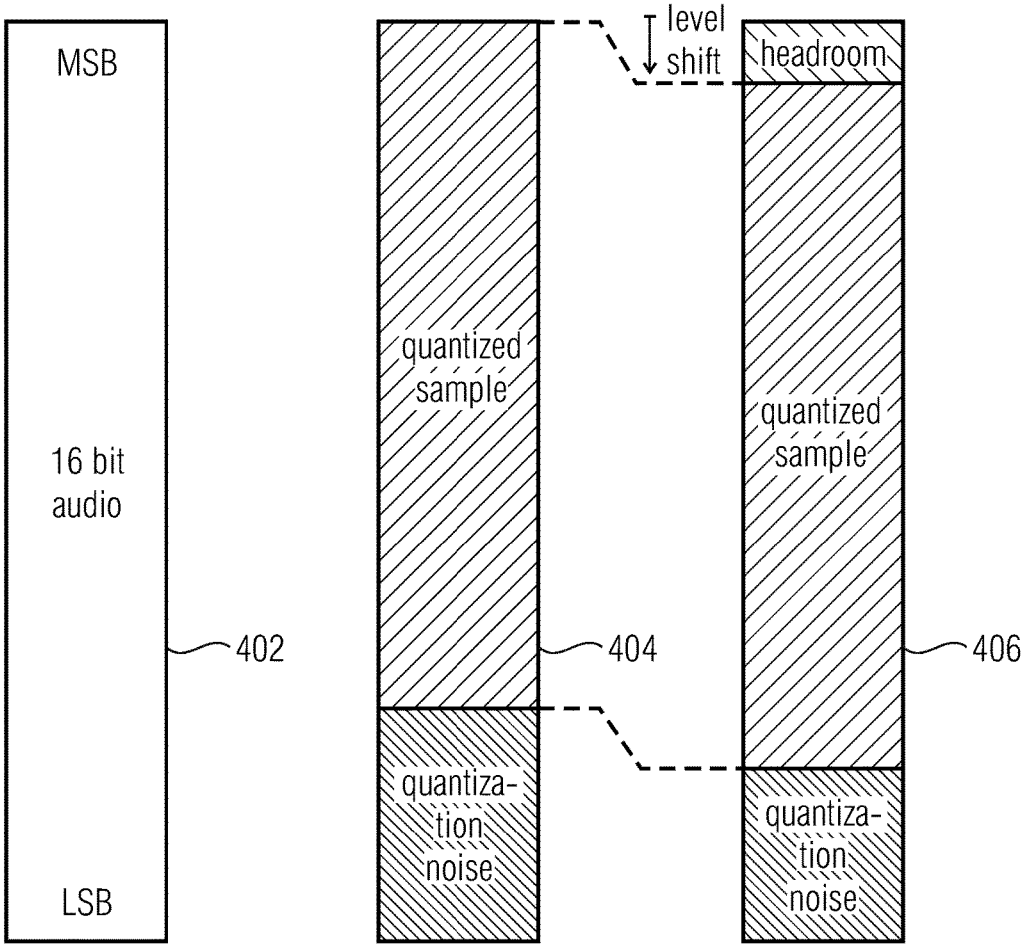

FIGS. 8A-8C schematically illustrate the effect of a level shift applied to the plurality of frequency band signal. An audio signal (e.g., each one of the plurality of frequency band signals) may be represented using a 16 bit resolution, as symbolized by the rectangle 402. The rectangle 404 schematically illustrates how the bits of the 16 bit resolution are employed to represent the quantized sample within one of the frequency band signals provided by the decoder preprocessing stage 110. It can be seen that the quantized sample may use a certain number of bits starting from the most significant bit (MSB) down to a last bit used for the quantized sample. The remaining bits down to the least significant bit (LSB) contain quantization noise, only. This may be explained by the fact that for the current frame the corresponding frequency band signal was represented within the bitstream by a reduced number of bits (<16 bits), only. Even if the full bit resolution of 16 bits was used within the bitstream for the current frame and for the corresponding frequency band, the least significant bit typically contains a significant amount of quantization noise.

A rectangle 406 in FIG. 8C schematically illustrates the result of level shifting the frequency band signal. As the content of the least significant bit(s) can be expected to contain a considerable amount of quantization noise, the quantized sample can be shifted towards the least significant bit, substantially without losing relevant information. This may be achieved by simply shifting the bits downwards ("right shift"), or by actually recalculating the binary representation. In both cases, the level shift factor may be memorized for later compensation of the applied level shift (e.g., by means of the level shift compensator 150 or 350). The level shift results in additional headroom at the most significant bit(s).

Figure 9:
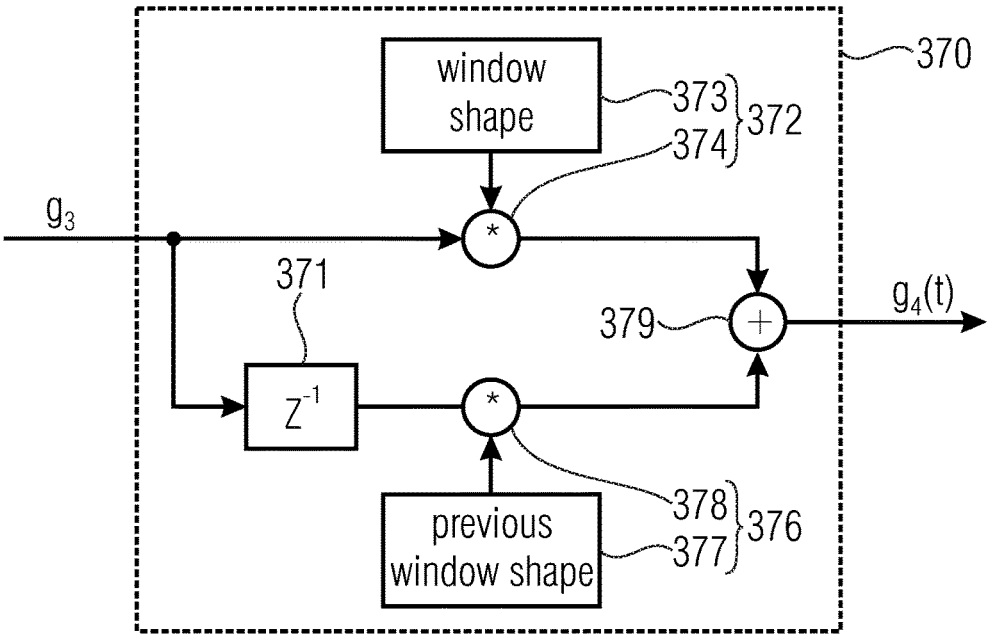
FIG. 9 shows a schematic block diagram of a possible transition shape adjustment that may be a component of the audio signal decoder or encoder according to at least some embodiments.

FIG. 9 schematically illustrates a possible implementation of the transition shape adjustment 370 shown in FIG. 7. The transition shape adjuster 370 may comprises a memory 371 for a previous level shift factor, a first windower 372 configured to generate a first plurality of windowed samples by applying a window shape to the current level shift factor, a second windower 376 configured to generate a second plurality of windowed samples by applying a previous window shape to the previous level shift factor provided by the memory 371, and a sample combiner 379 configured to combine mutually corresponding windowed samples of the first plurality of windowed samples and of the second plurality of windowed samples to obtain a plurality of combined samples. The first windower 372 comprises a window shape provider 373 and a multiplier 374. The second windower 376 comprises a previous window shape provider 377 and a further multiplier 378. The multiplier 374 and the further multiplier 378 output vectors over time. In the case of the first windower 372 each vector element corresponds to the multiplication of the current combined gain factor g3(t) (constant during the current frame) with the current window shape provided by the window shape provider 373. In the case of the second windower 376 each vector element corresponds to the multiplication of the previous combined gain factor g3(t−T) (constant during the previous frame) with the previous window shape provided by the previous window shape provider 377.

According to the embodiment schematically illustrated in FIG. 9, the gain factor from the previous frame has to be multiplied with the "second half" window of the filter-bank 340, while the actual gain factor is multiplied with the "first half" window sequence. These two vectors can be summed up to form one gain vector g4(t) to be element-wise multiplied with the audio signal X3(t) (see FIG. 7).

Window shapes may be guided by side information w from the filter-bank 340, if necessitated.

The window shape and the previous window shape may also be used by the frequency-to-time-domain converter 340 so that the same window shape and previous window shape are used for converting the level shifted frequency band signals into the time-domain representation and for windowing the current level shift factor and the previous level shift factor.

The current level shift factor may be valid for a current frame of the plurality of frequency band signals. The previous level shift factor may be valid for a previous frame of the plurality of frequency band signals. The current frame and the previous frame may overlap, for example by 50%.

The transition shape adjustment 370 may be configured to combine the previous level shift factor with a second portion of the previous window shape resulting in a previous frame factor sequence. The transition shape adjustment 370 may be further configured to combine the current level shift factor with a first portion of the current window shape resulting in a current frame factor sequence. A sequence of the cross-faded level shift factor may be determined on the basis of the previous frame factor sequence and the current frame factor sequence.

The proposed approach is not necessarily restricted to decoders, but also encoders might have a gain adjustment or limiter in combination with a filter-bank which might benefit from the proposed method.

Figure 10:
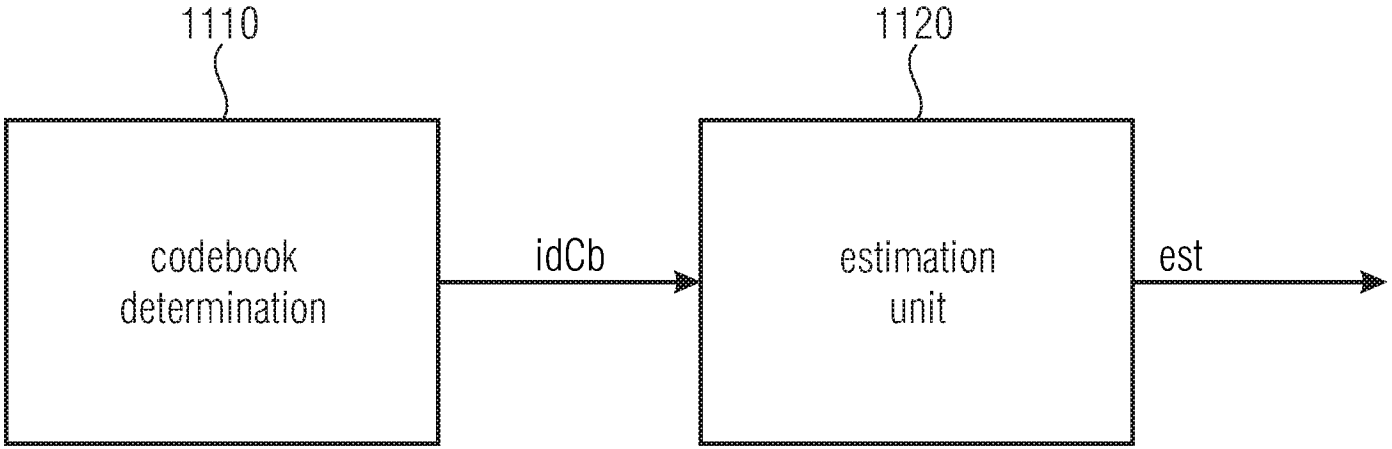
FIG. 10 depicts an estimation unit according to a further embodiment comprising a prediction filter adjuster.

FIG. 10 illustrates how the decoder preprocessing stage 110 and the clipping estimator 120 are connected. The decoder preprocessing stage 110 corresponds to or comprises the codebook determinator 1110. The clipping estimator 120 comprises an estimation unit 1120. The codebook determinator 1110 is adapted to determine a codebook from a plurality of codebooks as an identified codebook, wherein the audio signal has been encoded by employing the identified codebook. The estimation unit 1120 is adapted to derive a level value, e.g. an energy value, an amplitude value or a loudness value, associated with the identified codebook as a derived level value. Moreover, the estimation unit 1120 is adapted to estimate a level estimate, e.g. an energy estimate, an amplitude estimate or a loudness estimate, of the audio signal using the derived level value. For example, the codebook determinator 1110 may determine the codebook, that has been used by an encoder for encoding the audio signal, by receiving side information transmitted along with the encoded audio signal. In particular, the side information may comprise information identifying the codebook used for encoding a considered section of the audio signal. Such information may, for example, be transmitted from the encoder to the decoder as a number, identifying a Huffman codebook used for encoding the considered section of the audio signal.

Figure 11:
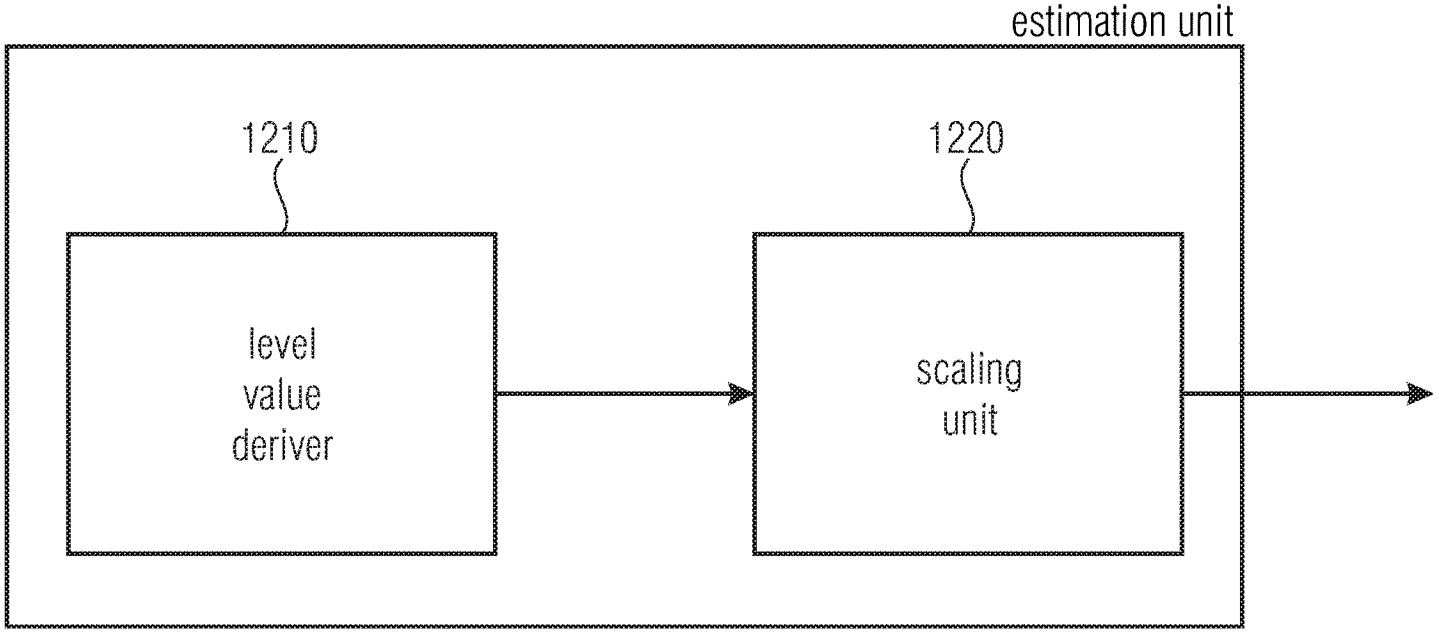
FIG. 11 illustrates an apparatus for generating a back data stream.

FIG. 11 illustrates an estimation unit according to an embodiment. The estimation unit comprises a level value deriver 1210 and a scaling unit 1220. The level value deriver is adapted to derive a level value associated with the identified codebook, i.e., the codebook that was used for encoding the spectral data by the encoder, by looking up the level value in a memory, by requesting the level value from a local database or by requesting the level value associated with the identified codebook from a remote computer. In an embodiment, the level value, that is looked-up or requested by the level value deriver, may be an average level value that indicates an average level of an encoded unscaled spectral value encoded by using the identified codebook.

By this, the derived level value is not calculated from the actual spectral values but instead, an average level value is used that depends only on the employed codebook. As has been explained before, the encoder is generally adapted to select the codebook from a plurality of codebooks that fit best to encode the respective spectral data of a section of the audio signal. As the codebooks differ, for example with respect to their maximum absolute value that can be encoded, the average value that is encoded by a Huffman codebook differs from codebook to codebook and, therefore, also the average level value of an encoded spectral coefficient encoded by a particular codebook differs from codebook to codebook.

Thus, according to an embodiment, an average level value for encoding a spectral coefficient of an audio signal employing a particular Huffman codebook can be determined for each Huffman codebook and can, for example, be stored in a memory, a database or on a remote computer. The level value deriver then simply has to look-up or request the level value associated with the identified codebook that has been employed for encoding the spectral data, to obtain the derived level value associated with the identified codebook.

However, it has to be taken into consideration that Huffman codebooks are often employed to encode unscaled spectral values, as it is the case for MPEG AAC. Then, however, scaling should be taken into account when a level estimate is conducted. Therefore, the estimation unit of FIG. 11 also comprises a scaling unit 1220. The scaling unit is adapted to derive a scalefactor relating to the encoded audio signal or to a portion of the encoded audio signal as a derived scalefactor. For example, with respect to a decoder, the scaling unit 1220 will determine a scalefactor for each scalefactor band. For example, the scaling unit 1220 may receive information about the scalefactor of a scalefactor band by receiving side information transmitted from an encoder to the decoder. The scaling unit 1220 is furthermore adapted to determine a scaled level value based on the scalefactor and the derived level value.

In an embodiment, where the derived level value is a derived energy value, the scaling unit is adapted to apply the derived scalefactor on the derived energy value to obtain a scaled level value by multiplying derived energy value by the square of the derived scalefactor.

In another embodiment, where the derived level value is a derived amplitude value, and the scaling unit is adapted to apply the derived scalefactor on the derived amplitude value to obtain a scaled level value by multiplying derived amplitude value by the derived scalefactor.

In a further embodiment, wherein the derived level value is a derived loudness value, and the scaling unit 1220 is adapted to apply the derived scalefactor on the derived loudness value to obtain a scaled level value by multiplying derived loudness value by the cube of the derived scalefactor. There exist alternative ways to calculate the loudness such as by an exponent 3/2. Generally, the scalefactors have to be transformed to the loudness domain, when the derived level value is a loudness value.

These embodiments take into account, that an energy value is determined based on the square of the spectral coefficients of an audio signal, that an amplitude value is determined based on the absolute values of the spectral coefficients of an audio signal, and that a loudness value is determined based on the spectral coefficients of an audio signal that have been transformed to the loudness domain.

Figure 12:
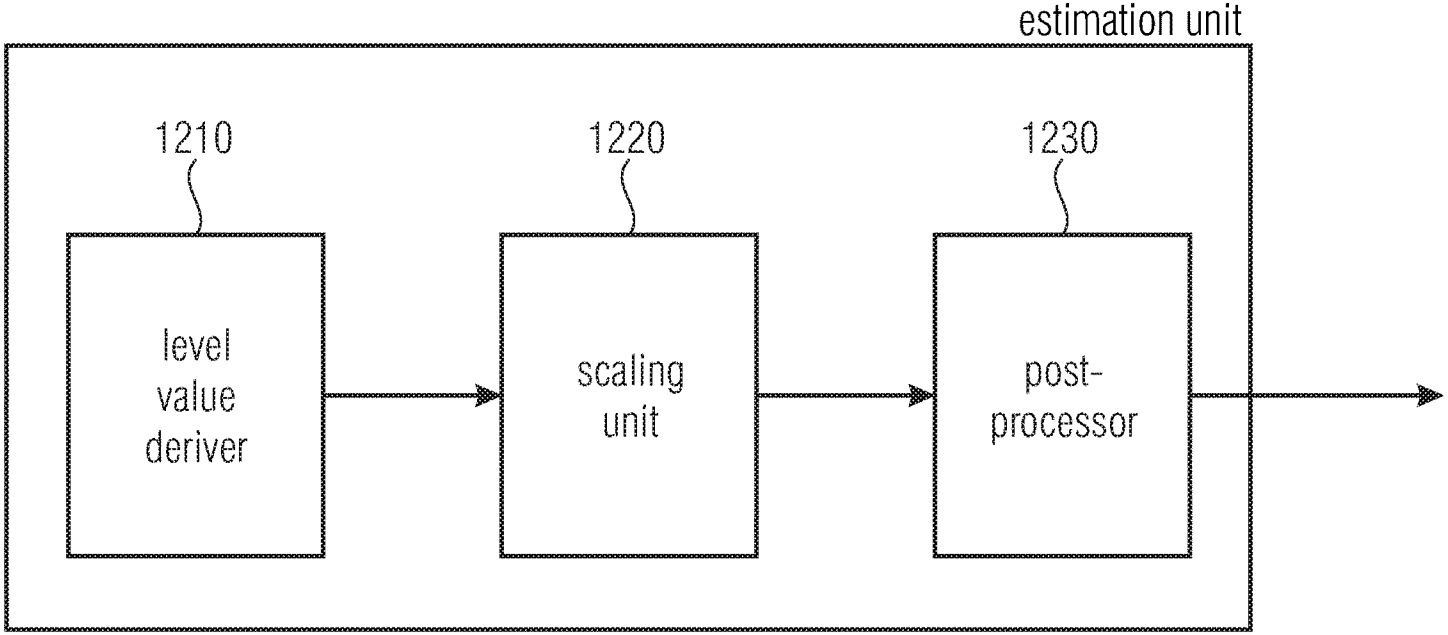
FIG 12 (PRIOR ART)
FIG. 12 illustrates an encoder according to the state of the art.

The estimation unit is adapted to estimate a level estimate of the audio signal using the scaled level value. In the embodiment of FIG. 11, the estimation unit is adapted to output the scaled level value as the level estimate. In this case, no post-processing of the scaled level value is conducted. However, as illustrated in the embodiment of FIG. 12, the estimation unit may also be adapted to conduct a post-processing. Therefore, the estimation unit of FIG. 12 comprises a post-processor 1230 for post-processing one or more scaled level values for estimating a level estimate. For example, the level estimate of the estimation unit may be determined by the post-processor 1230 by determining an average value of a plurality of scaled level values. This averaged value may be output by the estimation unit as level estimate.

In contrast to the presented embodiments, a state-of-the-art approach for estimating e.g. the energy of one scalefactor band would be to do the Huffman decoding and inverse quantization for all spectral values and compute the energy by summing up the square of all inversely quantized spectral values.

In the proposed embodiments, however, this computationally complex process of the state-of-the-art is replaced by an estimate of the average level which only depends on the scalefactor and the codebook uses and not on the actual quantized values.

Embodiments of the present invention employ the fact that a Huffman codebook is designed to provide optimal coding following a dedicated statistic. This means the codebook has been designed according to the probability of the data, e.g., AAC-ELD (AAC-ELD=Advanced Audio Coding-Enhanced Low Delay): spectral lines. This process can be inverted to get the probability of the data according to the codebook. The probability of each data entry inside a codebook (index) is given by the length of the codeword. For example, $$p(\text{index})=2\hat{}-\text{length}(\text{codeword})$$

i.e.

$$p(\text{index})=2^{-\text{length}(\text{codeword})}$$

wherein p(index) is the probability of a data entry (an index) inside a codebook.

Based on this, the expected level can be pre-computed and stored in the following way: each index represents a sequence of integer values (x), e.g., spectral lines, where the length of the sequence depends on the dimension of the codebook, e.g., 2 or 4 for AAC-ELD.

Figure 13A:
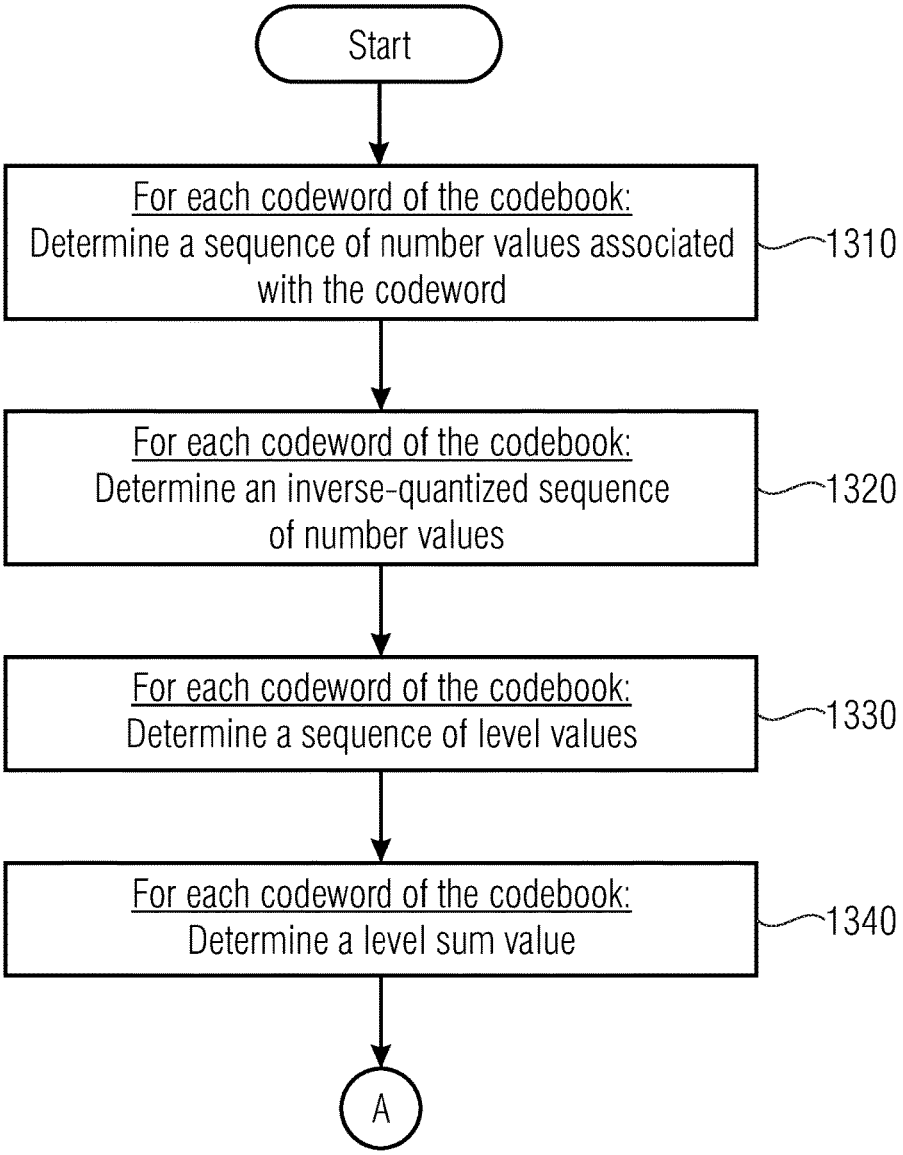
FIG 13A (PRIOR ART)
FIGS. 13A and 13B depict a decoder according to the state of the art.
Figure 13B:
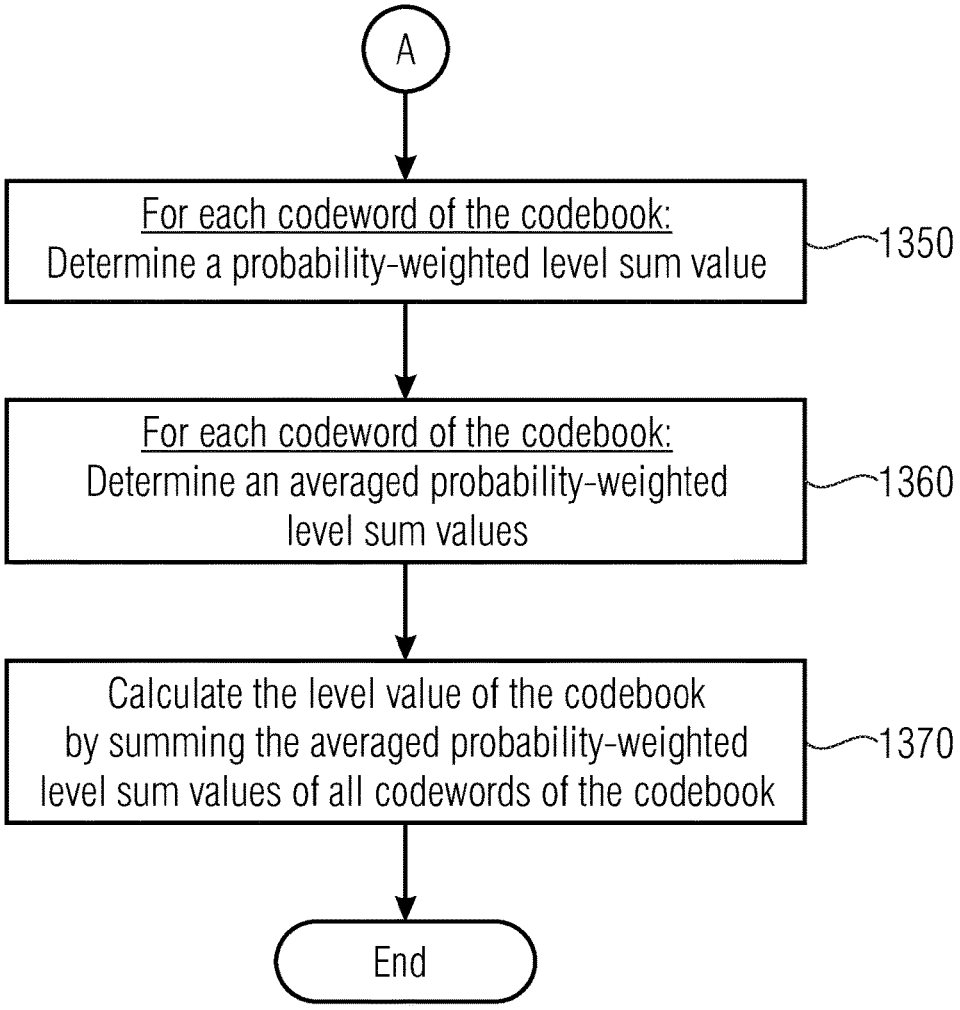
FIG 13B (PRIOR ART)

FIGS. 13A and 13B illustrate a method for generating a level value, e.g. an energy value, an amplitude value or a loudness value, associated with a codebook according to an embodiment. The method comprises:

Determining a sequence of number values associated with a codeword of the codebook for each codeword of the codebook (step 1310). As has been explained before, a codebook encodes a sequence of number values, for example, 2 or 4 number values by a codeword of the codebook. The codebook comprises a plurality of codebooks to encode a plurality of sequences of number values. The sequence of number values, that is determined, is the sequence of number values that is encoded by the considered codeword of the codebook. The step 1310 is conducted for each codeword of the codebook. For example, if the codebook comprises 81 codewords, 81 sequences of number values are determined in step 1310.

In step 1320, an inverse-quantized sequence of number values is determined for each codeword of the codebook by applying an inverse quantizer to the number values of the sequence of number values of a codeword for each codeword of the codebook. As has been explained before, an encoder may generally employ quantization when encoding the spectral values of the audio signal, for example non-uniform quantization. As a consequence, this quantization has to be inverted on a decoder side.

Afterwards, in step 1330, a sequence of level values is determined for each codeword of the codebook.

If an energy value is to be generated as the codebook level value, then a sequence of energy values is determined for each codeword, and the square of each value of the inverse-quantized sequence of number values is calculated for each codeword of the codebook.

If, however, an amplitude value is to be generated as the codebook level value, then a sequence of amplitude values is determined for each codeword, and the absolute value of each value of the inverse-quantized sequence of number values is calculated for each codeword of the codebook.

If, though, a loudness value is to be generated as the codebook level value, then a sequence of loudness values is determined for each codeword, and the cube of each value of the inverse-quantized sequence of number values is calculated for each codeword of the codebook. There exist alternative ways to calculate the loudness such as by an exponent 3/2. Generally, the values of the inverse-quantized sequence of number values have to be transformed to the loudness domain, when a loudness value is to be generated as the codebook level value.

Subsequently, in step 1340, a level sum value for each codeword of the codebook is calculated by summing the values of the sequence of level values for each codeword of the codebook.

Then, in step 1350, a probability-weighted level sum value is determined for each codeword of the codebook by multiplying the level sum value of a codeword by a probability value associated with the codeword for each codeword of the codebook. By this, it is taken into account that some of the sequence of number values, e.g., sequences of spectral coefficients, will not appear as often as other sequences of spectral coefficients. The probability value associated with the codeword takes this into account. Such a probability value may be derived from the length of the codeword, as codewords that are more likely to appear are encoded by using codewords having a shorter length, while other codewords that are more unlikely to appear will be encoded by using codewords having a longer length, when Huffman-encoding is employed.

In step 1360, an averaged probability-weighted level sum value for each codeword of the codebook will be determined by dividing the probability-weighted level sum value of a codeword by a dimension value associated with the codebook for each codeword of the codebook. A dimension value indicates the number of spectral values that are encoded by a codeword of the codebook. By this, an averaged probability-weighted level sum value is determined that represents a level value (probability-weighted) for a spectral coefficient that is encoded by the codeword.

Then, in step 1370, the level value of the codebook is calculated by summing the averaged probability-weighted level sum values of all codewords.

It has to be noted, that such a generation of a level value does only have to be done once for a codebook. If the level value of a codebook is determined, this value can simply be looked-up and used, for example by an apparatus for level estimation according to the embodiments described above.

In the following, a method for generating an energy value associated with a codebook according to an embodiment is presented. In order to estimate the expected value of the energy of the data coded with the given codebook, the following steps have to be performed only once for each index of the codebook:

A) apply the inverse quantizer to the integer values of the sequence (e.g. AAC-ELD: x^(4/3))

B) calculate energy by squaring each value of the sequence of A)

C) build the sum of the sequence of B)

D) multiply C) with the given probability of the index

E) divide by the dimension of the codebook to get the expected energy per spectral line.

Finally, all values calculated by E) have to be summed-up to get the expected energy of the complete codebook.

After the output of these steps is stored in a table, the estimated energy values can be simply looked-up based on the codebook index, i.e., depending on which codebook is used. The actual spectral values do not have to be Hoffman-decoded for this estimation.

To estimate the overall energy of the spectral data of a complete audio frame, the scalefactor has to be taken into account. The scalefactor can be extracted from the bit stream without a significant amount of complexity. The scalefactor may be modified before being applied on the expected energy, e.g. the square of the used scalefactor may be calculated. The expected energy is then multiplied with the square of the used scalefactor.

According to the above-described embodiments, the spectral level for each scalefactor band can be estimated without decoding the Huffman coded spectral values. The estimates of the level can be used to identify streams with a low level, e.g. with low power, which typically do not result in clipping. Therefore, the full decoding of such streams can be avoided.

According to an embodiment, an apparatus for level estimation further comprises a memory or a database having stored therein a plurality of codebook level memory values indicating a level value being associated with a codebook, wherein each one of the plurality of codebooks has a codebook level memory value associated with it stored in the memory or database. Furthermore, the level value deriver is configured for deriving the level value associated with the identified codebook by deriving a codebook level memory value associated with the identified codebook from the memory or from the database.

The level estimated according to the above-described embodiments can vary if a further processing step as prediction, such as prediction filtering, are applied in the codec, e.g., for AAC-ELD TNS (Temporal Noise Shaping) filtering. Here, the coefficients of the prediction are transmitted inside the bit stream, e.g., for TNS as PARCOR coefficients.

Figure 14:
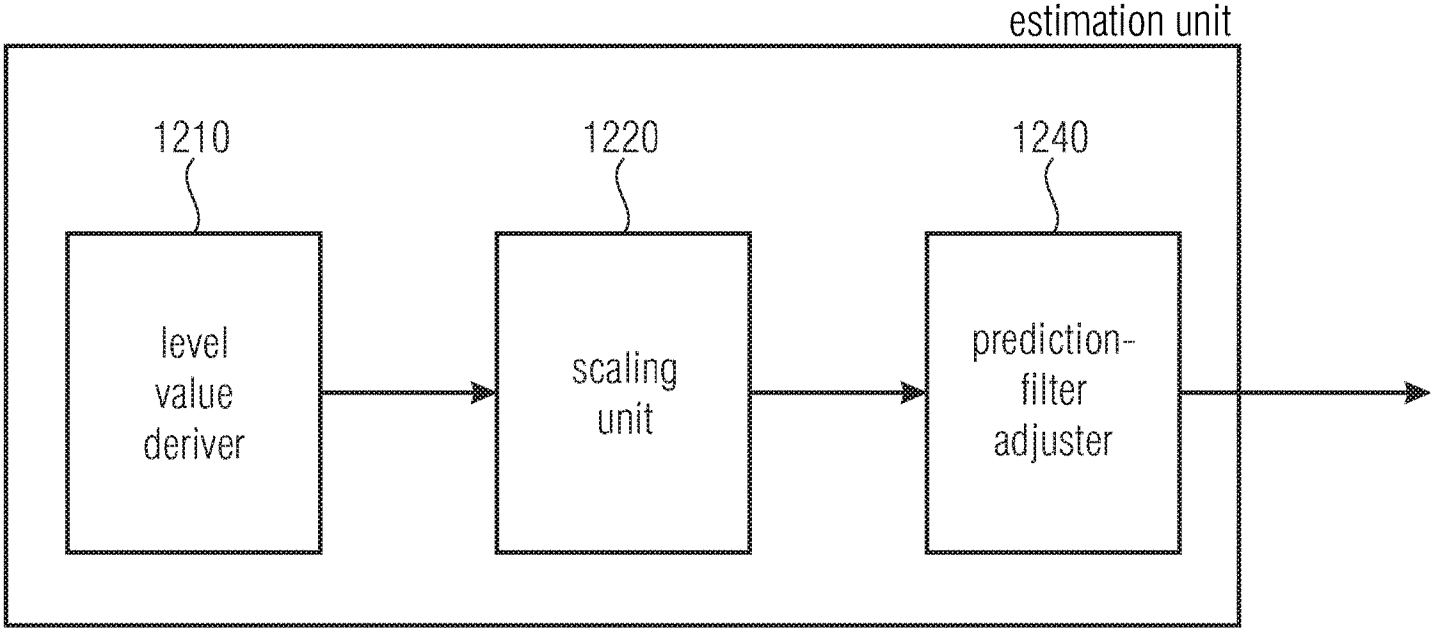
FIG 14 (PRIOR ART)
FIG. 14 illustrates another encoder according to the state of the art.

FIG. 14 illustrates an embodiment wherein the estimation unit further comprises a prediction filter adjuster 1240. The prediction filter adjuster is adapted to derive one or more prediction filter coefficients relating to the encoded audio signal or to a portion of the encoded audio signal as derived prediction filter coefficients. Moreover, the prediction filter adjuster is adapted to obtain a prediction-filter-adjusted level value based on the prediction filter coefficients and the derived level value. Furthermore, the estimation unit is adapted to estimate a level estimate of the audio signal using the prediction-filter-adjusted level value.

In an embodiment, the PARCOR coefficients for TNS are used as prediction filter coefficients. The prediction gain of the filtering process can be determined from those coefficients in a very efficient way. Regarding TNS, the prediction gain can be calculated according to the formula: gain=1/prod(1−parcor.^2).

For example, if 3 PARCOR coefficients, e.g., parcor1, parcor2 and parcor3 have to be taken into consideration, the gain is calculated according to the formula:

$$\text{gain} = \frac{1}{(1 - parcor_1^2)(1 - parcor_2^2)(1 - parcor_3^2)}$$

For n PARCOR coefficients $\text{parcor}_1$, $\text{parcor}_2$, . . . $\text{parcor}_n$, the following formula applies:

$$\text{gain} = \frac{1}{(1 - parcor_1^2)(1 - parcor_2^2) \ldots (1 - parcor_n^2)}$$

This means that the amplification of the audio signal through the filtering can be estimated without applying the filtering operation itself.

Figure 15:
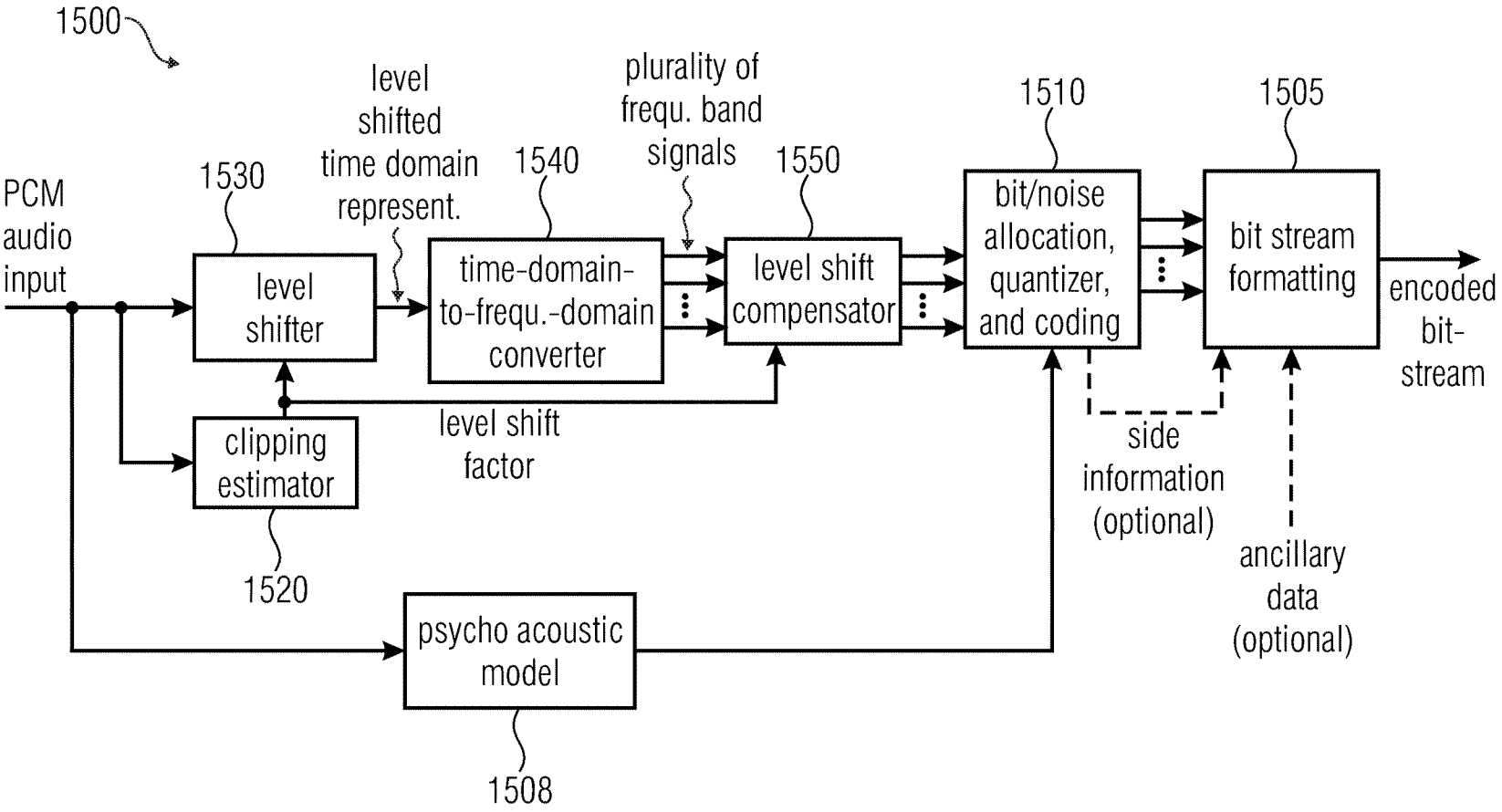
FIG. 15 shows a schematic block diagram of an audio signal encoder according to at least one embodiment.

FIG. 15 shows a schematic block diagram of an encoder 1500 that implements the proposed gain adjustment which "bypasses" the filter-bank. The audio signal encoder 1500 is configured to provide an encoded audio signal representation on the basis of a time-domain representation of an input audio signal. The time-domain representation may be, for example, a pulse code modulated audio input signal.

The audio signal encoder comprises a clipping estimator 1520 configured to analyze the time-domain representation of the input audio signal in order to determine a current level shift factor for the input signal representation. The audio signal encoder further comprises a level shifter 1530 configured to shift a level of the time-domain representation of the input audio signal according to the level shift factor for obtaining a level shifted time-domain representation. A time-to-frequency domain converter 1540 (e.g., a filter-bank, such as a bank of quadrature mirror filters, a modified discrete cosine transform, etc.) is configured to convert the level shifted time-domain representation into a plurality of frequency band signals. The audio signal encoder 1500 also comprises a level shift compensator 1550 configured to act on the plurality of frequency band signals for at least partly compensating a level shift applied to the level shifted time-domain representation by the level shifter 1530 and for obtaining a plurality of substantially compensated frequency band signals.

The audio signal encoder 1500 may further comprise a bit/noise allocation, quantizer, and coding component 1510 and a psychoacoustic model 1508. The psychoacoustic model 1508 determines time-frequency-variable masking thresholds on (and/or frequency-band-individual and frame-individual quantization resolutions, and scale factors) the basis of the PCM input audio signal, to be used by the bit/noise allocation, quantizer, and coding 1610. Details regarding one possible implementation of the psychoacoustic model and other aspects of perceptual audio encoding can be found, for example, in the International Standards ISO/IEC 11172-3 and ISO/IEC 13818-3. The bit/noise allocation, quantizer, and coding 1510 is configured to quantize the plurality of frequency band signals according to their frequency-band-individual and frame-individual quantization resolutions, and to provide these data to a bitstream formatter 1505 which outputs an encoded bitstream to be provided to one or more audio signal decoders. The bit/noise allocation, quantizer, and coding 1510 may be configured to determine side information in addition the plurality quantized frequency signals. This side information may also be provided to the bitstream formatter 1505 for inclusion in the bitstream.

Figure 16:
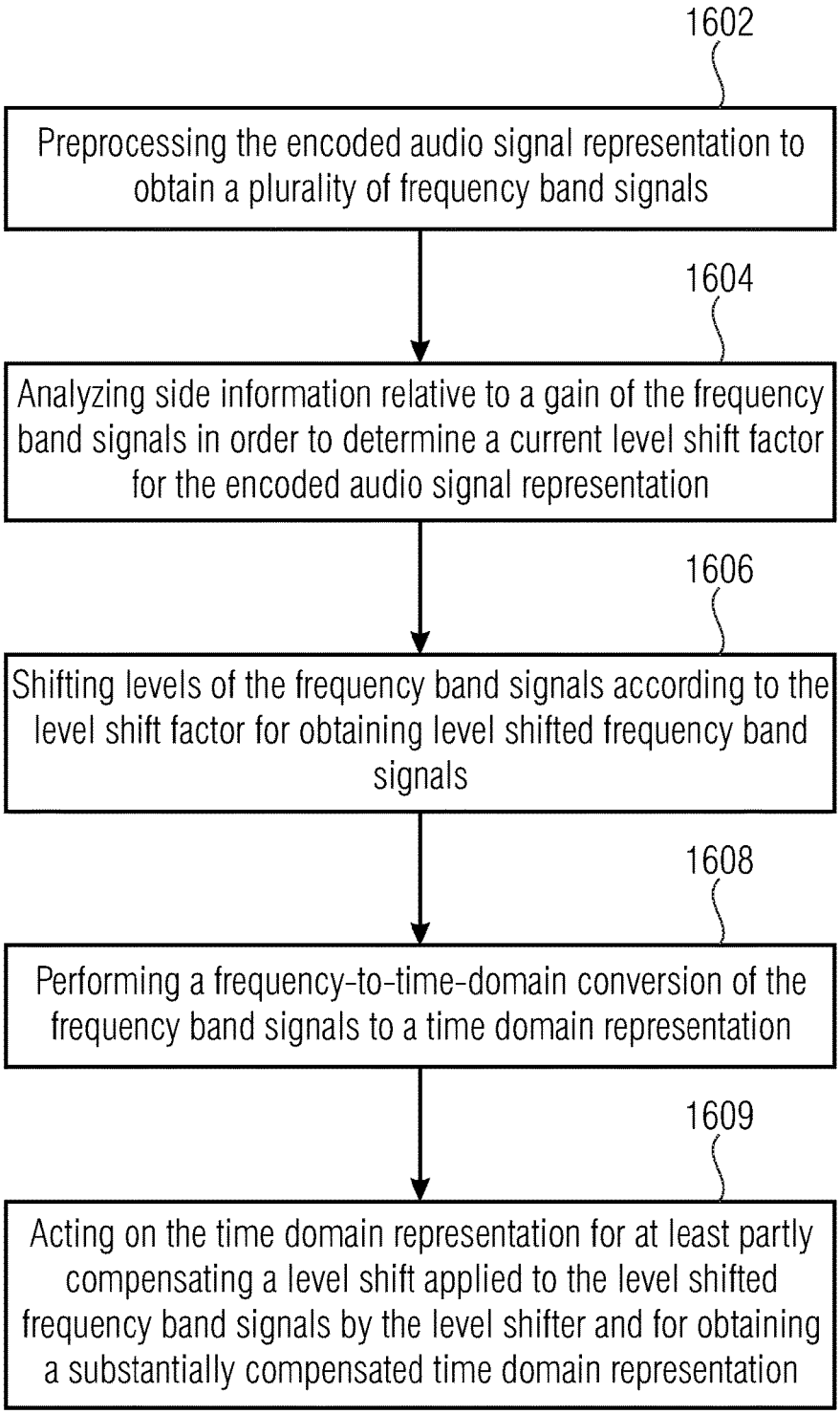
FIG. 16 shows a schematic flow diagram of a method for decoding the encoded audio signal representation according to at least one embodiment.

FIG. 16 shows a schematic flow diagram of a method for decoding an encoded audio signal representation in order to obtain a decoded audio signal representation. The method comprises a step 1602 of preprocessing the encoded audio signal representation to obtain a plurality of frequency band signals. In particular, preprocessing may comprise unpacking a bitstream into data corresponding to successive frames, and re-quantizing (inverse quantizing) frequency band-related data according to frequency band-specific quantization resolutions to obtain a plurality of frequency band signals.

In a step 1604 of the method for decoding, side information relative to a gain of the frequency band signals is analyzed in order to determine a current level shift factor for the encoded audio signal representation. The gain relative to the frequency band signals may be individual for each frequency band signal (e.g., the scale factors known in some perceptual audio coding schemes or similar parameters) or common to all frequency band signal (e.g., the global gain known in some perceptual audio encoding schemes). The analysis of the side information allows gathering information about a loudness of the encoded audio signal during the frame at hand. The loudness, in turn, may indicate a tendency of the decoded audio signal representation to go into clipping. The level shift factor is typically determined as a value that prevents such clipping while preserving a relevant dynamic range and/or relevant information content of (all) the frequency band signals.

The method for decoding further comprises a step 1606 of shifting levels of the frequency band signal according to the level shift factor. In case the frequency band signals are level shifted to a lower level, the level shift creates some additional headroom at the most significant bit(s) of a binary representation of the frequency band signals. This additional headroom may be needed when converting the plurality of frequency band signals from the frequency domain to the time domain to obtain a time domain representation, which is done in a subsequent step 1608. In particular, the additional headroom reduces the risk of the time domain representation to clip if some of the frequency band signals are close to an upper limit regarding their amplitude and/or power. As a consequence, the frequency-to-time-domain conversion may be performed using a relatively small word length.

The method for decoding also comprises a step 1609 of acting on the time domain representation for at least partly compensating a level shift applied to the level shifted frequency band signals. Subsequently, a substantially compensated time representation is obtained.

Accordingly, a method for decoding an encoded audio signal representation to a decoded audio signal representation comprises:

preprocessing the encoded audio signal representation to obtain a plurality of frequency band signals;

analyzing side information relative to a gain of the frequency band signals in order to determine a current level shift factor for the encoded audio signal representation;

shifting levels of the frequency band signals according to the level shift factor for obtaining level shifted frequency band signals;

performing a frequency-to-time-domain conversion of the frequency band signals to a time-domain representation; and acting on the time-domain representation for at least partly compensating a level shift applied to the level shifted frequency band signals and for obtaining a substantially compensated time-domain representation.

According to further aspects, analyzing the side information may comprise: determining a clipping probability on the basis of the side information and to determine the current level shift factor on the basis of the clipping probability.

According to further aspects, the side information may comprise at least one of a global gain factor for the plurality of frequency band signals and a plurality of scale factors, each scale factor corresponding to one frequency band signal of the plurality of frequency band signals.

According to further aspects, preprocessing the encoded audio signal representation may comprise obtaining the plurality of frequency band signals in the form of a plurality of successive frames, and analyzing the side information may comprise determining the current level shift factor for a current frame.

According to further aspects, the decoded audio signal representation may be determined on the basis of the substantially compensated time-domain representation.

According to further aspects, the method may further comprise: applying a time domain limiter characteristic subsequent to acting on the time-domain representation for at least partly compensating the level shift.

According to further aspects, the side information relative to the gain of the frequency band signals may comprise a plurality of frequency band-related gain factors.

According to further aspects, preprocessing the encoded audio signal may comprise re-quantizing each frequency band signal using a frequency band-specific quantization indicator of a plurality of frequency band-specific quantization indicators.

According to further aspects, the method may further comprise performing a transition shape adjustment, the transition shape adjustment comprising: crossfading the current level shift factor and a subsequent level shift factor to obtain a crossfaded level shift factor for use during the action of at least partly compensating the level shift.

According to further aspects, the transition shape adjustment may further comprise:

temporarily storing a previous level shift factor, generating a first plurality windowed samples by applying a window shape to the current level shift factor, generating a second plurality of windowed samples by applying a previous window shape to the previous level shift factor provided by the action of temporarily storing the previous level shift factor, and combining mutually corresponding windowed samples of the first plurality of windowed samples and of the second plurality of windowed samples to obtain a plurality of combined samples.

According to further aspects, the window shape and the previous window shape may also be used by the frequency-to-time-domain conversion so that the same window shape and previous window shape are used for converting the level shifted frequency band signals into the time-domain representation and for windowing the current level shift factor and the previous level shift factor.

According to further aspects, the current level shift factor may be valid for a current frame of the plurality of frequency band signals, wherein the previous level shift factor may be valid for a previous frame of the plurality of frequency band signals, and wherein the current frame and the previous frame may overlap. The transition shape adjustment may be configured to combine the previous level shift factor with a second portion of the previous window shape resulting in a previous frame factor sequence, to combine the current level shift factor with a first portion of the current window shape resulting in a current frame factor sequence, and to determine a sequence of the crossfaded level shift factor on the basis of the previous frame factor sequence and the current frame factor sequence.

According to further aspects, analyzing the side information may be performed with respect to whether the side information suggests a potential clipping within the time-domain representation which means that a least significant bit contains no relevant information, and wherein in this case the level shift shifts information towards the least significant bit so that by freeing a most significant bit some headroom at the most significant bit is gained.

According to further aspects, a computer program for implementing the method for decoding or the method for encoding may be provided, when the computer program is being executed on a computer or signal processor.

Although some aspects have been described in the context of an apparatus, it is clear that these aspects also represent a description of the corresponding method, where a block or device corresponds to a method step or a feature of a method step. Analogously, aspects described in the context of a method step also represent a description of a corresponding block or item or feature of a corresponding apparatus.

The inventive decomposed signal can be stored on a digital storage medium or can be transmitted on a transmission medium such as a wireless transmission medium or a wired transmission medium such as the Internet.

Depending on certain implementation requirements, embodiments of the invention can be implemented in hardware or in software. The implementation can be performed using a digital storage medium, for example a floppy disk, a DVD, a CD, a ROM, a PROM, an EPROM, an EEPROM or a FLASH memory, having electronically readable control signals stored thereon, which cooperate (or are capable of cooperating) with a programmable computer system such that the respective method is performed.

Some embodiments according to the invention comprise a non-transitory data carrier having electronically readable control signals, which are capable of cooperating with a programmable computer system, such that one of the methods described herein is performed.

Generally, embodiments of the present invention can be implemented as a computer program product with a program code, the program code being operative for performing one of the methods when the computer program product runs on a computer. The program code may for example be stored on a machine readable carrier.

Other embodiments comprise the computer program for performing one of the methods described herein, stored on a machine readable carrier.

In other words, an embodiment of the inventive method is, therefore, a computer program having a program code for performing one of the methods described herein, when the computer program runs on a computer.

A further embodiment of the inventive methods is, therefore, a data carrier (or a digital storage medium, or a computer-readable medium) comprising, recorded thereon, the computer program for performing one of the methods described herein.

A further embodiment of the inventive method is, therefore, a data stream or a sequence of signals representing the computer program for performing one of the methods described herein. The data stream or the sequence of signals may for example be configured to be transferred via a data communication connection, for example via the Internet.

A further embodiment comprises a processing means, for example a computer, or a programmable logic device, configured to or adapted to perform one of the methods described herein.

A further embodiment comprises a computer having installed thereon the computer program for performing one of the methods described herein.

In some embodiments, a programmable logic device (for example a field programmable gate array) may be used to perform some or all of the functionalities of the methods described herein. In some embodiments, a field programmable gate array may cooperate with a microprocessor in order to perform one of the methods described herein. Generally, the methods may be performed by any hardware apparatus.

While this invention has been described in terms of several embodiments, there are alterations, permutations, and equivalents which will be apparent to others skilled in the art and which fall within the scope of this invention. It should also be noted that there are many alternative ways of implementing the methods and compositions of the present invention. It is therefore intended that the following appended claims be interpreted as including all such alterations, permutations, and equivalents as fall within the true spirit and scope of the present invention.

The invention claimed is:

1. An audio signal decoder configured to provide a decoded audio signal representation on the basis of an encoded audio signal representation, the audio signal decoder comprising:

a decoder preprocessing stage configured to acquire a plurality of frequency band signals from the encoded audio signal representation;

a clipping estimator configured to analyze side information relative to a gain of the frequency band signals of the encoded audio signal representation as to whether the side information suggests a potential clipping in order to determine a current level shift factor for the encoded audio signal representation, wherein when the side information suggest the potential clipping, the current level shift factor causes information of the plurality of frequency band signals to be shifted towards a least significant bit so that headroom at at least one most significant bit is gained;

a level shifter configured to shift levels of the frequency band signals according to the current level shift factor for acquiring level shifted frequency band signals;

a frequency-to-time-domain converter configured to convert the level shifted frequency band signals into a time-domain representation; and a level shift compensator configured to act on the time-domain representation for at least partly compensating a level shift applied to the level shifted frequency band signals by the level shifter and for acquiring a compensated time-domain representation.

2. The audio signal decoder according to claim 1, wherein the clipping estimator is further configured to determine a clipping probability on the basis of at least one of the side information and the encoded audio signal representation, and to determine the current level shift factor on the basis of the clipping probability.

3. The audio signal decoder according to claim 1, wherein the side information comprises at least one of a global gain factor for the plurality of frequency band signals and a plurality of scale factors, each scale factor corresponding to one frequency band signal or one group of frequency band signals within the plurality of frequency band signals.

4. The audio signal decoder according to claim 1, wherein the decoder preprocessing stage is configured to acquire the plurality of frequency band signals in the form of a plurality of successive frames, and wherein the clipping estimator is configured to determine the current level shift factor for a current frame.

5. The audio signal decoder according to claim 1, wherein the decoded audio signal representation is determined on the basis of the compensated time-domain representation.

6. The audio signal decoder according to claim 1, further comprising a time domain limiter downstream of the level shift compensator.

7. The audio signal decoder according to claim 1, wherein the side information relative to the gain of the frequency band signals comprises a plurality of frequency band-related gain factors.

8. The audio signal decoder according to claim 1, wherein the decoder preprocessing stage comprises an inverse quantizer configured to re-quantize each frequency band signal using a frequency band-specific quantization indicator of a plurality of frequency band-specific quantization indicators.

9. The audio signal decoder according to claim 1, further comprising a transition shape adjuster configured to crossfade the current level shift factor and a subsequent level shift factor to acquire a crossfaded level shift factor for use by the level shift compensator.

10. The audio signal decoder according to claim 9, wherein the transition shape adjuster comprises a memory for a previous level shift factor, a first windower configured to generate a first plurality of windowed samples by applying a window shape to the current level shift factor, a second windower configured to generate a second plurality of windowed samples by applying a previous window shape to the previous level shift factor provided by the memory, and a sample combiner configured to combine mutually corresponding windowed samples of the first plurality of windowed samples and of the second plurality of windowed samples to acquire a plurality of combined samples.

11. The audio signal decoder according to claim 10, wherein the current level shift factor is valid for a current frame of the plurality of frequency band signals, wherein the previous level shift factor is valid for a previous frame of the plurality of frequency band signals, and wherein the current frame and the previous frame overlap;

wherein the transition shape adjustment is configured to combine the previous level shift factor with a second portion of the previous window shape resulting in a previous frame factor sequence, to combine the current level shift factor with a first portion of the current window shape resulting in a current frame factor sequence, and to determine a sequence of the crossfaded level shift factor on the basis of the previous frame factor sequence and the current frame factor sequence.

12. The audio signal decoder according to claim 1, wherein the clipping estimator is configured to analyze at least one of the encoded audio signal representation and the side information with respect to whether at least one of the encoded audio signal representation and the side information suggests a potential clipping within the time-domain representation which means that a least significant bit comprises no relevant information, and wherein in this case the level shift applied by the level shifter shifts information towards the least significant bit so that by freeing a most significant bit some headroom at the most significant bit is gained.

13. The audio signal decoder according to claim 1, wherein the clipping estimator comprises:

a codebook determinator for determining a codebook from a plurality of codebooks as an identified codebook, wherein the encoded audio signal representation has been encoded by employing the identified codebook, and an estimation unit configured for deriving a level value associated with the identified codebook as a derived level value and, for estimating a level estimate of the audio signal using the derived level value.

14. An audio signal encoder configured to provide an encoded audio signal representation on the basis of a time-domain representation of an input audio signal, the audio signal encoder comprising:

a clipping estimator configured to analyze the time-domain representation of the input audio signal as to whether potential clipping is suggested in order to determine a current level shift factor for the input signal representation, wherein when the potential clipping is suggested, the current level shift factor causes the time-domain representation of the input audio signal to shifted towards a least significant bit so that headroom at at least one most significant bit is gained;

a level shifter configured to shift a level of the time-domain representation of the input audio signal according to the current level shift factor for acquiring a level shifted time-domain representation;

a time-to-frequency domain converter configured to convert the level shifted time-domain representation into a plurality of frequency band signals; and a level shift compensator configured to act on the plurality of frequency band signals for at least partly compensating a level shift applied to the level shifted time-domain representation by the level shifter and for acquiring a plurality of compensated frequency band signals.

15. A method for decoding an encoded audio signal representation and for providing a corresponding decoded audio signal representation, the method comprising:

preprocessing the encoded audio signal representation to acquire a plurality of frequency band signals;

analyzing side information relative to a gain of the frequency band signals as to whether the side information suggest a potential clipping in order to determine a current level shift factor for the encoded audio signal representation, wherein when the side information suggests the potential clipping, the current level shift factor causes information of the plurality of frequency band signals to be shifted towards a least significant bit so that headroom at at least one most significant bit is gained;

shifting levels of the frequency band signals according to the level shift factor for acquiring level shifted frequency band signals;

performing a frequency-to-time-domain conversion of the frequency band signals to a time-domain representation; and acting on the time-domain representation for at least partly compensating a level shift applied to the level shifted frequency band signals and for acquiring a compensated time-domain representation.

16. A non-transitory storage medium having stored thereon a computer program for instructing a computer to perform the method of claim 15.

* * * * *